US007243860B2

(12) United States Patent
Junkel et al.

(10) Patent No.: US 7,243,860 B2
(45) Date of Patent: Jul. 17, 2007

(54) PORTABLE MISTING DEVICE WITH DRINKING SPOUT AND FAN ASSIST

(75) Inventors: Eric J. Junkel, Des Plaines, IL (US); Lee Radtke, Lake Zurich, IL (US); Jim Glasgow, Chicago, IL (US); Linda Usher, Chicago, IL (US)

(73) Assignee: Squeeze Breeze.Circulair, a division of GLJ, LLC, Chicao, IL (US)

( * ) Notice: Subject to any disclaimer, the term of this patent is extended or adjusted under 35 U.S.C. 154(b) by 204 days.

(21) Appl. No.: 10/974,098

(22) Filed: Oct. 27, 2004

(65) Prior Publication Data

US 2006/0086821 A1 Apr. 27, 2006

(51) Int. Cl.

| | |
|---|---|
| ***A62C 13/62*** | (2006.01) |
| ***A62C 5/02*** | (2006.01) |
| ***A62C 5/00*** | (2006.01) |
| ***F23D 14/28*** | (2006.01) |

(52) U.S. Cl. ..... 239/302; 239/310; 239/311; 239/337; 239/553.5

(58) Field of Classification Search ..... 239/302, 239/310, 311, 337, 338, 373, 548, 551, 553.5; 222/209, 400.8, 401
See application file for complete search history.

(56) References Cited

U.S. PATENT DOCUMENTS

| | | | | |
|---|---|---|---|---|
| 3,389,079 | A * | 6/1968 | Litt | 210/650 |
| 5,304,035 | A * | 4/1994 | Carter | 416/63 |
| 5,715,999 | A * | 2/1998 | Hsu | 239/29 |
| 5,799,873 | A | 9/1998 | Lau | 239/33 |
| 6,010,034 | A * | 1/2000 | Walthers | 222/135 |
| 6,161,777 | A * | 12/2000 | Carter et al. | 239/222.11 |
| 6,213,358 | B1 * | 4/2001 | Libit et al. | 222/633 |

* cited by examiner

*Primary Examiner*—David D. Hwu
(74) *Attorney, Agent, or Firm*—Gifford, Krass, Sprinkle, Anderson & Citkowski, P.C.

(57) ABSTRACT

A portable misting device having a body with an internal and fluid holding reservoir. A fill port provides for refilling of the fluid holding reservoir and one or more discharge ports are in fluidic communication with the reservoir. A fluid conveying conduit extends from the discharge port and terminates in an orifice. The orifice typically includes both spray misting and drinking components.

20 Claims, 26 Drawing Sheets

Fig-14
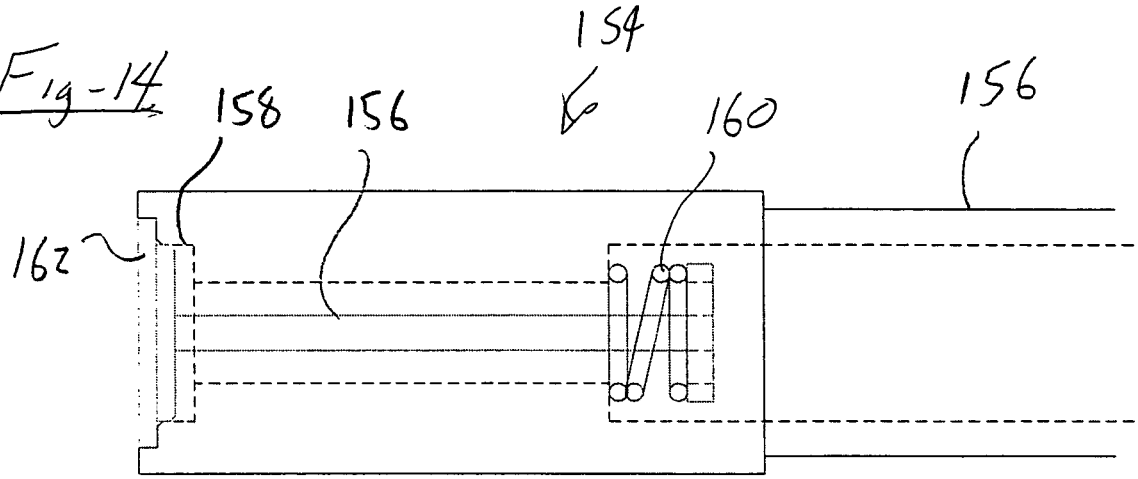
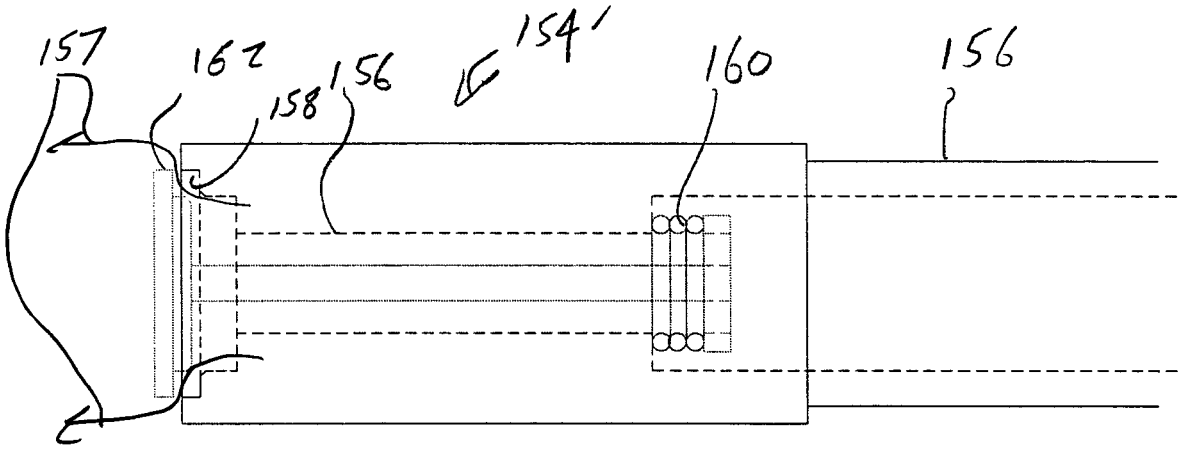
Fig-14A

PORTABLE MISTING DEVICE WITH DRINKING SPOUT AND FAN ASSIST

BACKGROUND OF THE INVENTION

1. Field of the Invention

The present invention relates generally to hydration packs such as are used by hikers, bikers and other athletes and in order to carry volumes of water in portable fashion. More specifically, the present invention teaches a device which incorporates a misting function to an associated mouthpiece or drinking nipple and in a compact fashion.

2. Description of the Prior Art

Fluid filled bladder devices incorporating both soft, semi-rigid and hardened sides are known in the art. In order to prevent a potable fluid from pouring out of the drinking nipple, when not placed in the user's mouth, most such nipples incorporate a valve of some type. Examples of such an assembly include Edison U.S. Pat. No. 5,060,833; Carnel U.S. Pat. No. 5,722,573 and Motsenbocker U.S. Pat. No. 4,420,097.

Such prior art assembly may in particular include both bite valves and suction operated valves. As such bite valves are often found not to be perfectly leak-proof, a secondary shutoff valve may also be incorporated.

Practically known hydration packs are further known to include at least one opening or port on the reservoir for admitting potable water (or other drinkable fluid) and a closure to prevent leakage of the water out of the reservoir. It is also known to include a second smaller opening with a closure to attach such as a supply tube for the drinking nipple.

Personal mister devices and misting fans are also well known in the art. These issue a fine mist of water into the air, the evaporation of which results in the cooling of the air surrounding the droplets. Fans driven with electrical motors are further known which propel the cooled air stream and mist, such as in a direction toward the user. Portable misting fans have also been in use for at least the last several preceding years and which employ a battery operated fan located atop a trigger spray bottle. Examples drawn from the prior art in this area include Steiner U.S. Pat. No. 4,839,106; Steiner U.S. Pat. No. 5,338,495; Arnieri et al. U.S. Pat. No. 6,217,294; Hsu U.S. Pat. No. 6,378,845; Hsu U.S. Pat. No. 5,752,662; Hsu U.S. Pat. No. 5,715,999; Junkel et al. U.S. Pat. Nos. 5,843,344; 6,398,132; 5,620,633; 5,667,731; and 5,965,067. Other examples include Lederer U.S. Pat. Nos. 5,667,732 and 5,837,167, as well as Utter U.S. Pat. Nos. 6,216,961 and 6,371,388.

Another example of a portable multi-port liquid dispensing system is set forth in U.S. Pat. No. 5,799,873, issued to Lan, and which allows the user to either receive a spray of liquid for cooling or a stream of water for drinking. A spray head is attachable to the body, which in turn attaches to a container. Once assembled, the user may drink liquid from the container by sucking on the straw protruding from the body. Simultaneously, or sequentially, with drinking from the straw the user may receive a spray from the ejector.

Among the previously referenced prior art are battery operated misting fans typically having a small, rigid bottle as a reservoir and with a pump sprayer attached to the neck of the bottle. While the atomizing of the water droplets issued from the pump sprayer cools the air somewhat and evaporation of the mist from the end user's skin cools some more, this effect is greatly enhanced with the addition of the fan to speed the evaporative cooling of the mist and the moisture on the user's skin.

SUMMARY OF THE PRESENT INVENTION

The present invention is a hydration pack for use by such as hikers, bikers and athletes, and which provides the ability to carry volumes of water portably. As will be further described, the portable misting device also allows the user to issue either or both of a spray mist or a steady stream fluid.

The misting device includes a body having an internal and fluid holding reservoir. Depending upon the variant of misting device, the contents of the fluid holding reservoir may either be unpressurized or under a specified degree of pressurization. A fill port is provided for refilling the fluid holding reservoir and at least one discharge port is in fluidic communication with the reservoir.

A fluid conveying conduit, typically in the form of a flexible neck, extends from the discharge port and terminates in at least a spray misting orifice. Preferred embodiments of the invention include the provision of both spray misting and drinking ports for issuing fluid from the reservoir and through the flexible conduit. In order to achieve satisfactory fluid flow, a combination of mechanisms are employed for generating the necessary pressure within the fluid reservoir or spray/pour subassembly, these including, among others, various types of fluid pumps (including squeeze bulbs) and piston/cylinder arrangements. Also, a portable fan attachment may be used in conjunction with the spray misting component and in order to provide an added degree of evaporative cooling.

BRIEF DESCRIPTION OF THE DRAWINGS

Reference will now be made to the attached drawings, when read in combination with the following detailed description, wherein like reference numerals refer to like parts throughout the several views, and in which:

FIG. 14 is a sectional illustration of a suction operated valve incorporated into a drinking nipple and in a normally closed position;

FIG. 14A is a succeeding sectional illustration of the suction operated and by which the annular end disk is translated to an open and fluid issuing condition;

DETAILED DESCRIPTION OF THE PREFERRED EMBODIMENTS

Figure 1:
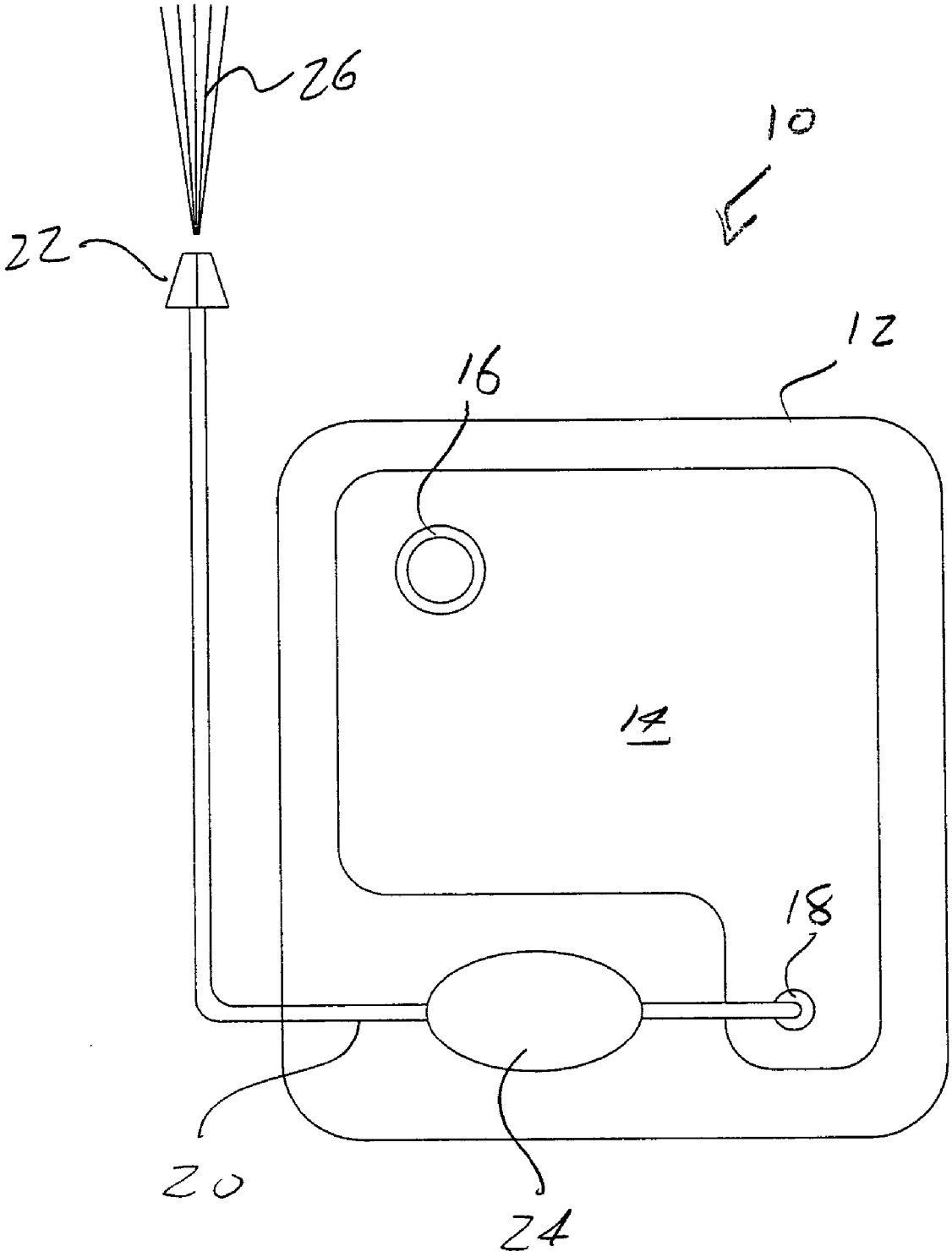
FIG. 1 is an illustration of a first mist bag concept including a reservoir with a large fill port and a smaller discharge port attached to a squeeze bulb pump by a length of conduit and according to a first embodiment of the present invention.

Referring now to FIG. 1, a portable misting device is illustrated at 10 according to a first preferred embodiment of the present invention. As previously described, the misting device with drinking spout and fan assist makes possible the-portability and convenience of both spray misting and drinking water for use with hikers, athletes and the like.

Referring again to FIG. 1, the illustration 10 of the first mist bag concept includes the provision of a body 12 having an internal and fluid holding reservoir 14. A fill port 16 provides for selective refilling of the reservoir, such as with water or other suitable (and typically potable) fluid.

A smaller discharge port 18 is also in fluid communication with the reservoir 14. A length of conduit 20, typically flexible in nature, extends from the discharge port 18 and terminates in an end orifice 22. A pressure inducing source is provided in the form of a squeeze bulb 24, which is located at a location along the length of conduit. As is understood, the squeeze bulb may be attached as shown or may be located upon a reservoir side of the body 12. Actuation of the pump 24 results in fluid being drawing from the reservoir, out through the discharge port 18, through the conduit 20, and issued as a mist spray 26 through the orifice 22.

Figure 2:
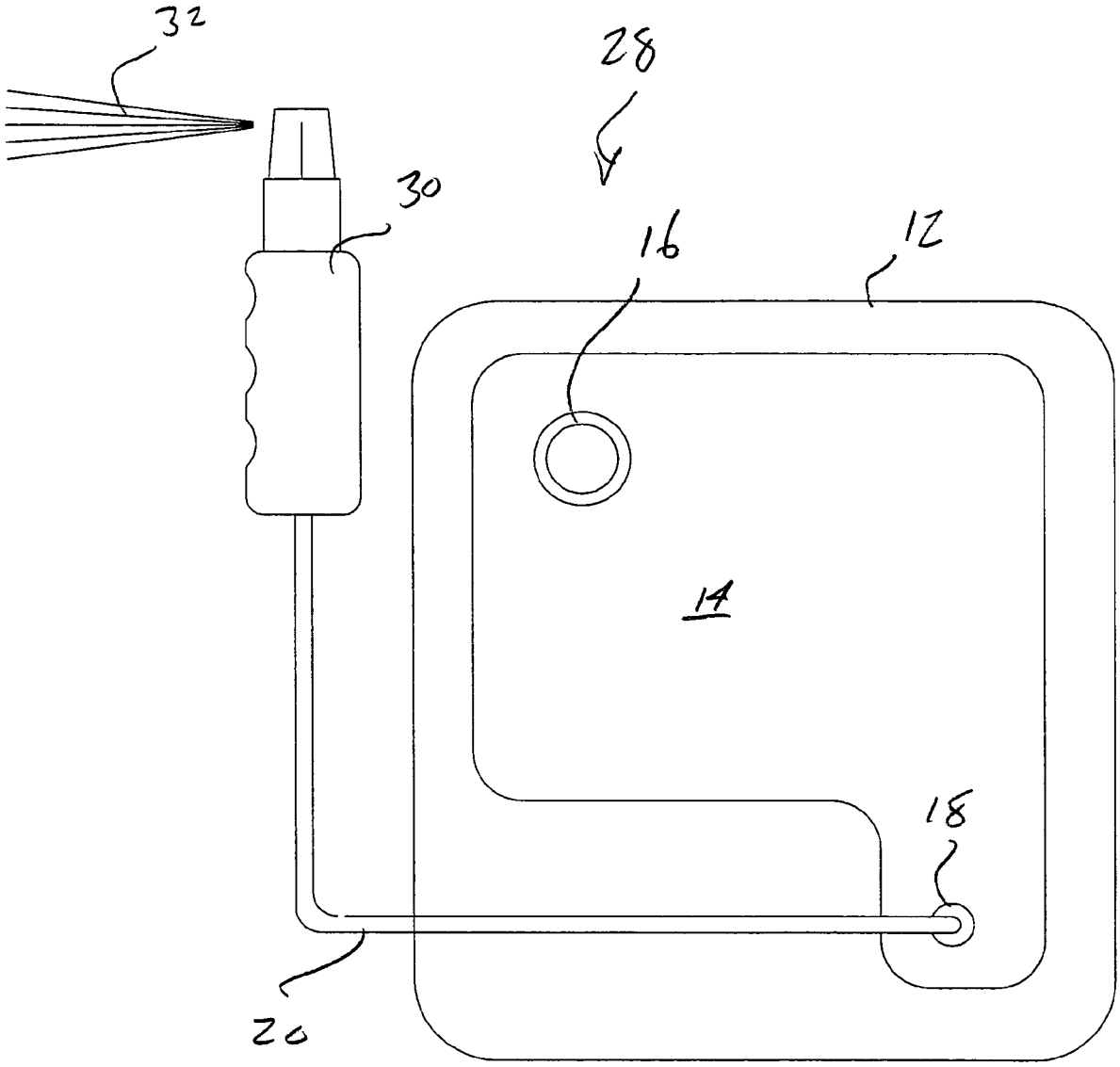
FIG. 2 is an illustration of a mist bag according to a second preferred embodiment and which includes a refillable reservoir with filling and discharge ports, a piston pump operable with a conduit associated with the second discharge port.

Referring now to FIG. 2, an illustration is shown at 28 of a mist bag according to a second preferred embodiment and which again includes a body 12 constructed substantially identically to that described in FIG. 1. FIG. 2 differs from FIG. 1 in that a piston pump sprayer 30 substitutes for the squeeze bulb 24 and which is operable with the conduit 20 associated with the discharge port 18 to issue a mist spray 32.

Figure 3:
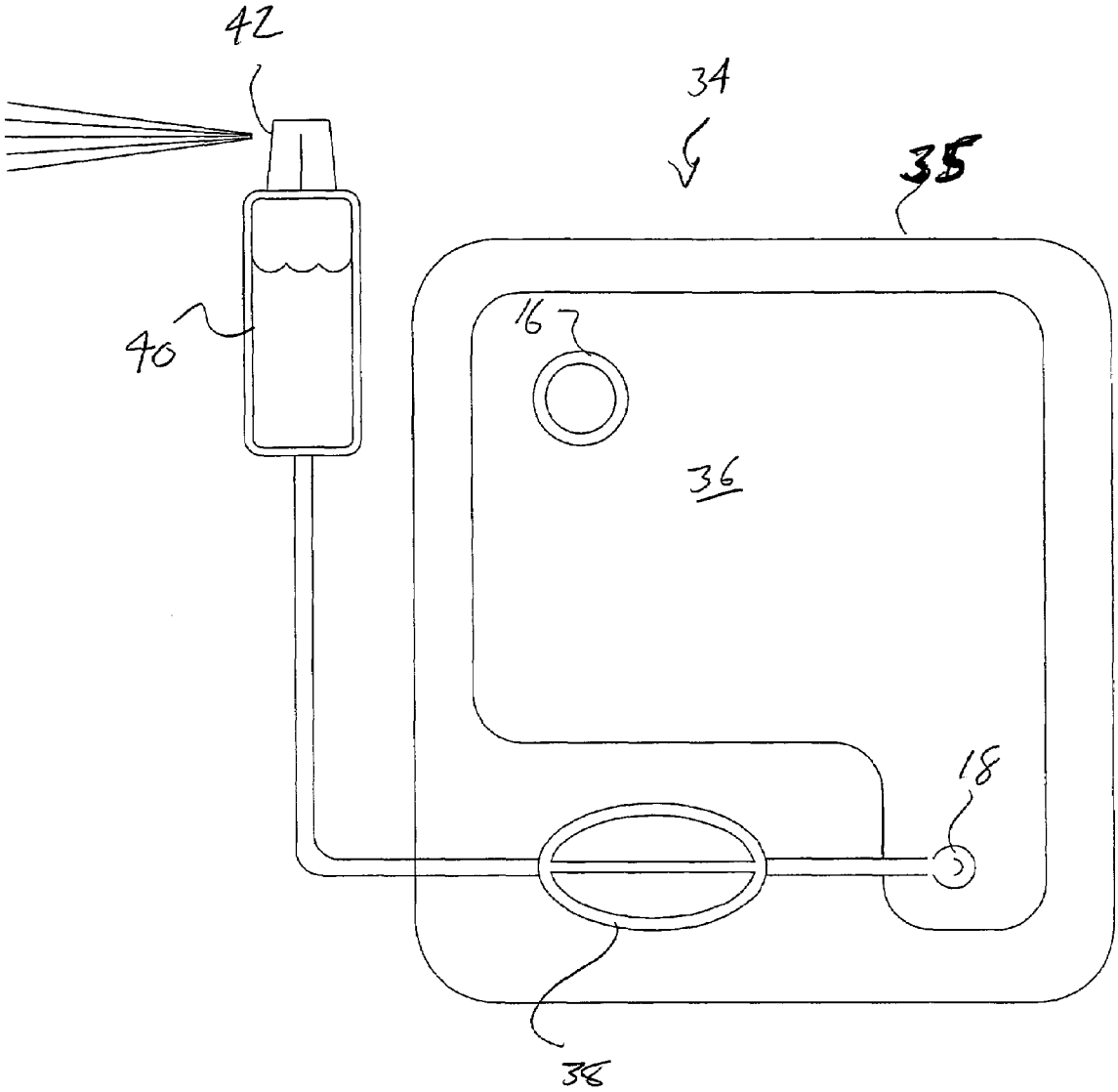
FIG. 3 is an illustration of a mist bag according to a third preferred embodiment and by which the fluid contents of a refillable reservoir are maintained at lower pressure and attached to a dual chamber pump and for introducing both and air into the pressure vessel, the same being capped with an aerosol valve.

Referring now to FIG. 3, an illustration 34 of a mist bag according to a third preferred embodiment again teaches a body 35 and an internal reservoir 36, the fluid contents of which are maintained at lower pressure and attached to a dual chamber pump 38 and which, upon being squeezed, introduces both water and air into a pressure vessel, see at 40, the same being capped with an aerosol valve 42 for issuing the mist spray. As with the embodiments of FIGS. 1 and 2, the reservoir is accessed by an inlet/fill port 16 and an outlet/discharge port 18. Despite modifications to several of the embodiments to be subsequently described, it is understood that certain elements such as fill port 16 and discharge port 18 may be repetitively numbered, for convenience.

Figure 4:
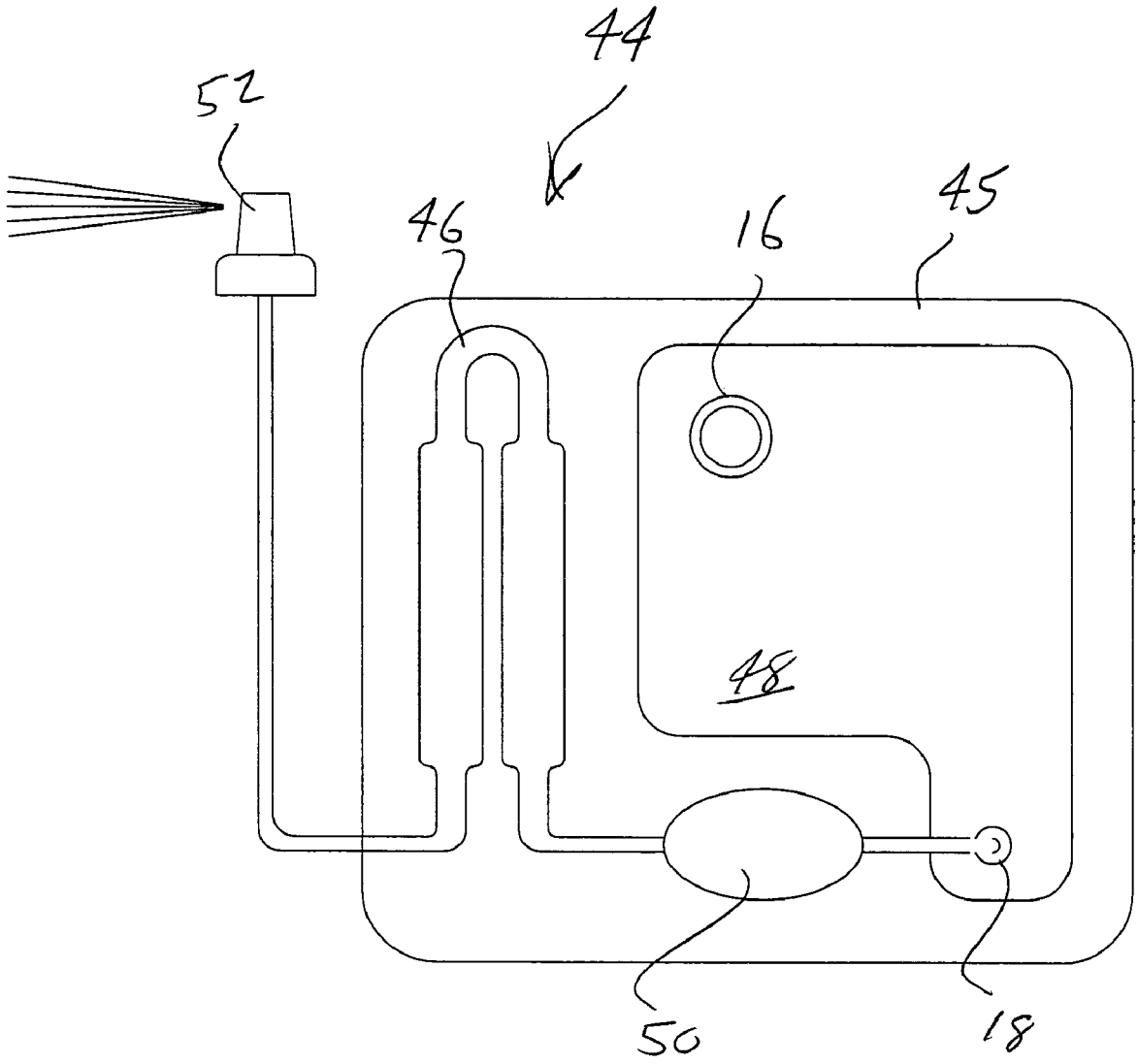
FIG. 4 is an illustration of a mist bag according to a fourth preferred embodiment and including an elastic wall pressure vessel in operative communication with a reservoir enclosure by means of a squeeze bulb pump and for issuing a continuous aerosol mist.

As shown in FIG. 4, a mist bag 44 according to a fourth preferred embodiment includes a body 45 within which is configured an elastic wall pressure vessel 46 in operative communication with a reservoir enclosure 48, and by means of a squeeze bulb pump 50, issues a continuous aerosol mist through a spray orifice 52. The pressure vessel can exhibit elastic walls and store energy by stretching the vessel walls, instead of air compression. The pump in this variant is simple because only water (no air) needs to be pressurized. As with the third preferred embodiment, the mist can emanate continuously from the nozzle instead of in discrete bursts. As with the earlier disclosed embodiments, the variant 44 includes a fluid fill port 16 and discharge port 18.

Figure 5:
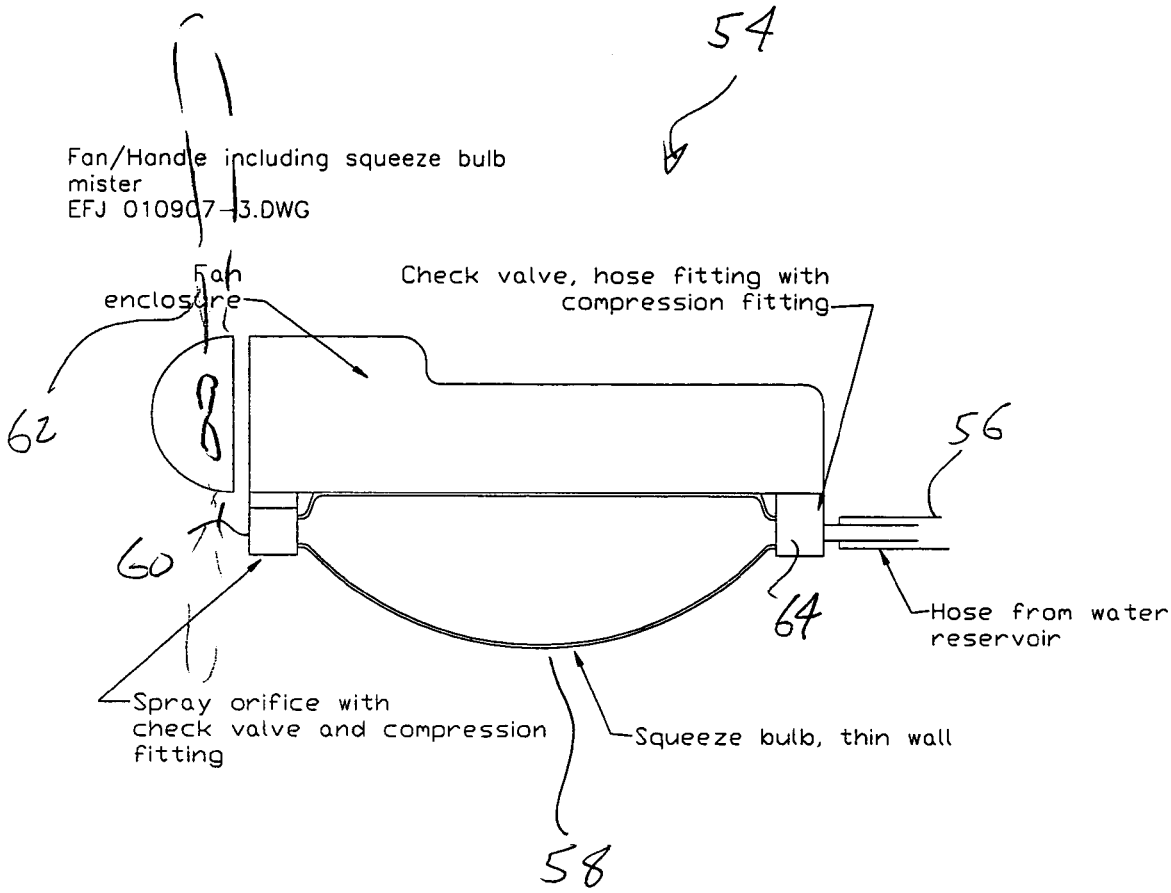
FIG. 5 is an illustration of a misting fan handpiece, attached to a low pressure reservoir by a length of conduit, and which operates to issue a mist directly into the path of a plurality of rotating fan blades.

Referring now to FIG. 5, an illustration is shown at 54 of a misting fan handpiece, and which is attached to a low pressure reservoir (not shown) by a length of conduit, see at 56. A thin walled and squeeze bulb 58 is actuated to issue a mist through a spray orifice 60 and directly into the path of a plurality of rotating fan blades 62. Additional features include a check valve 64 for interconnecting the conduit 56 with the squeeze bulb 58.

Figure 6:
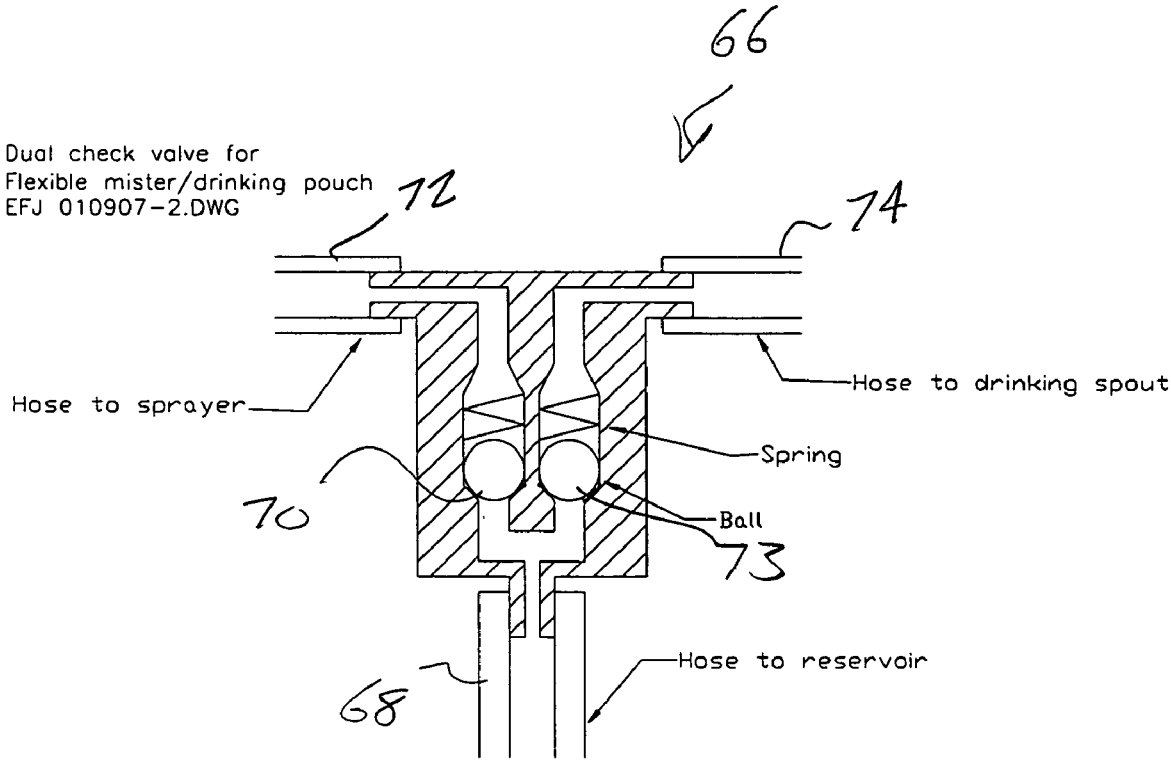
FIG. 6 is a sectional illustration of a dual check valve incorporated into the present device and which operates to prevent such as saliva contamination resulting from backwash into the pump and common water supply, and by which it could be misted out onto someone other than the user of the mouthpiece.

Referring to FIG. 6, a sectional illustration 66 is provided of a dual check valve incorporated into the present device and which operates to prevent such as saliva contamination resulting from backwash into the pump and common water supply, and by which it could be misted out onto someone other than the user of the mouthpiece. In particular, the check valve 66 is connected to an extending end of a hose or conduit 68 and includes, in the embodiment illustrated, a first spring-loaded ball valve assembly 70 fluidly communicating the conduit 68 to a discharge associated with the spray mister 72.

A second spring-loaded ball valve assembly 73 is arranged in parallel with the first ball valve assembly 70 and likewise fluidly communicates the conduit 68 to a discharge associated with the drinking spout 74 (the particulars of which will be subsequently discussed in additional detail). The term ball valve is further intended to encompass any fluid control device that operates between full closed to open position. Each of the check valves operates to prevent fluid backwash into the common fluid supply (reservoir).

Figure 7:
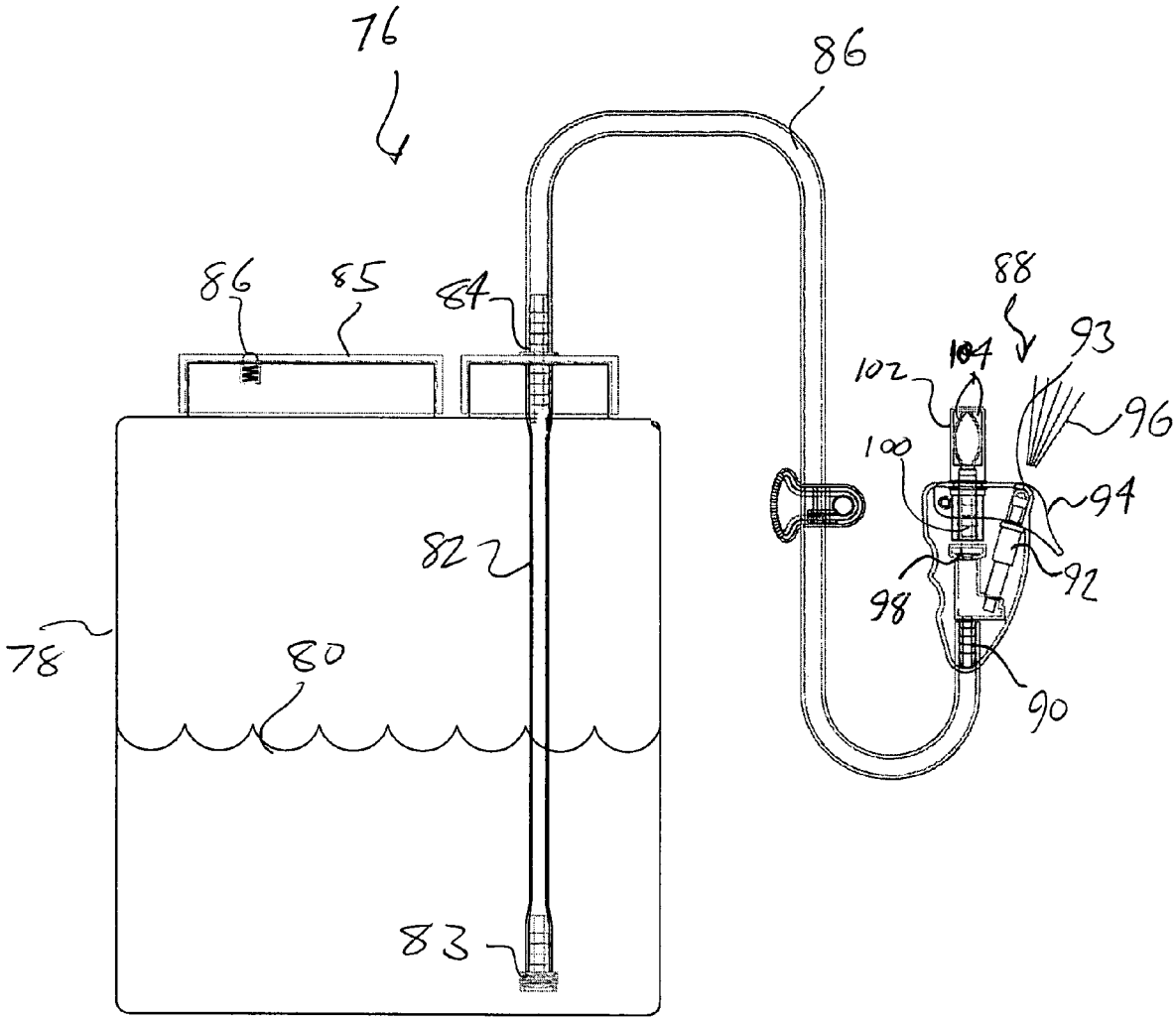
FIG. 7 is an illustration of a combined misting and drinking device according to a further preferred embodiment and which includes a conduit extending from a fluid filled reservoir and terminating in a hand-held pump subassembly for issuing fluid in either of misting and drinking conditions.

Referring now to FIG. 7, an illustration is shown at 76 of a combined misting and drinking device according to a further preferred embodiment. A body 78 includes a fluid reservoir 80. A dip tube 82 extends within the reservoir 80, and includes an inlet check valve 83, an opposite end of the dip tube and connects to a discharge port and closure 84. A fill port 85 and closure includes a one-way valve suction release 86 and for refilling the fluid reservoir.

A conduit 86, typically flexible, extends from the fluid filled reservoir, and typically from the discharge port and closure 84. The conduit 86 terminates in a hand-held pump subassembly 88 for issuing fluid in either of misting and drinking conditions. In particular, and referencing also the enlarged views of FIGS. 8 and 8A, the pump subassembly includes an inlet plenum 90, a piston pump 92 secured to a first outlet associated with the plenum 90, an orifice 93 in turn defining an outlet location of the piston pump 92. A pump actuator arm 94 is secured to a body of the subassembly 88 and, upon being depressed, engages the piston pump 92 to issue a mist spray 96. It is also envisioned that the term arm can also encompass any manually operable mechanism for effecting displacement of the associated pump, and such as potentially a pushbutton.

Additional components of the pump subassembly include a flapper-type check valve 98, in operative communication with a second outlet 100 associated with the plenum 90. A drinking nipple 102 incorporating a bite valve insert, see convex walls 104, deforms upon being biased (such as by a user's teeth) and which causes a steady stream fluid flow through the nipple 102 when the user sucks on the nipple. The term bite valve, as most broadly defined is interpreted to further include any fluid control device operable using the mouth, (lips, tongue, teeth or breath).

Figure 9:
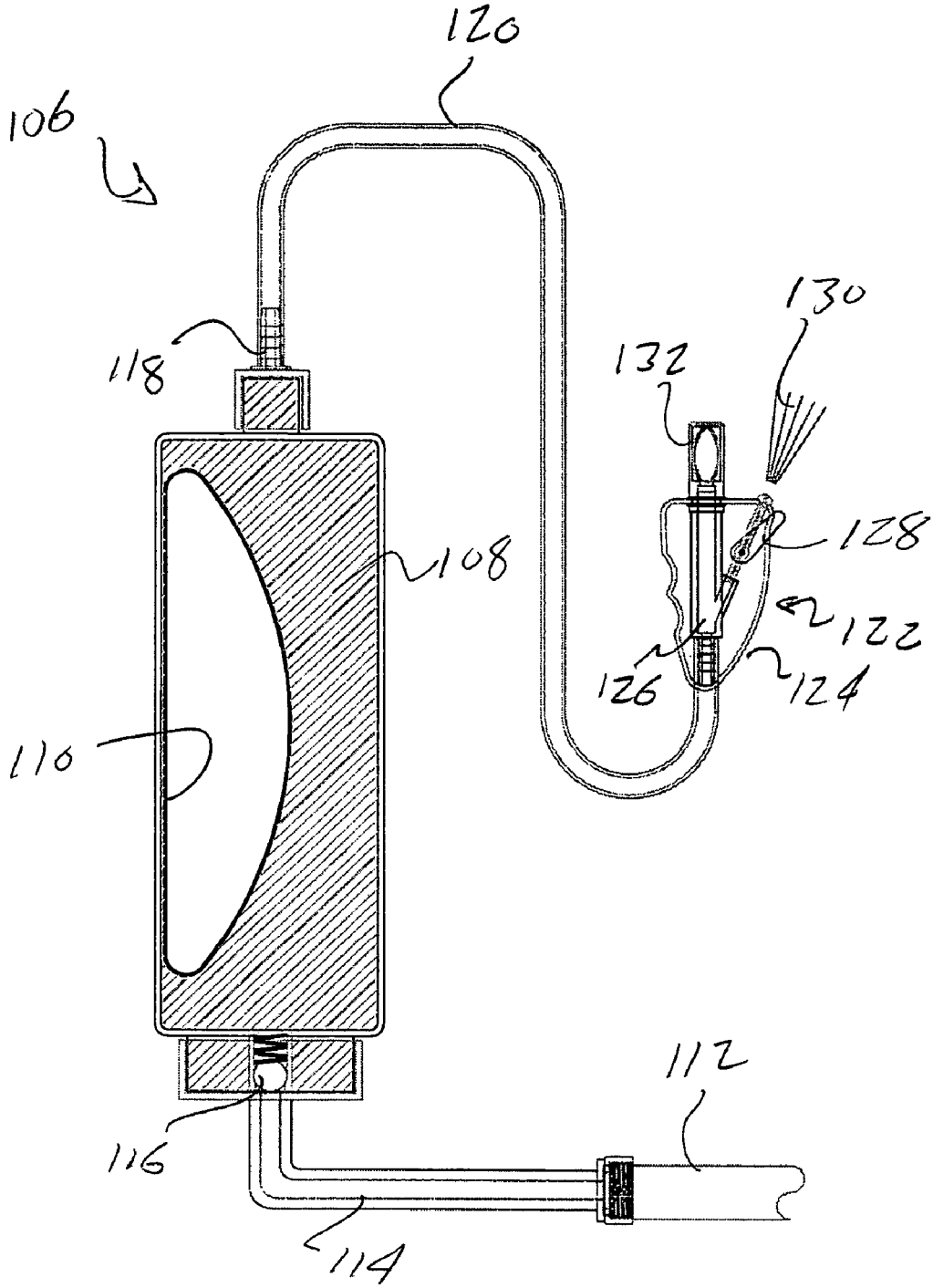
FIG. 9 is an illustration of a hydration system incorporating a pressurized reservoir, and which further includes an internally disposed and pressurized air bladder for issuing a combined drinking source and mist to a conduit connected pump sub-assembly.

Referring now to FIG. 9, an illustration is shown at 106 of a hydration system incorporating a pressurized reservoir 108, and which further includes an internally disposed and pressurized air bladder 110 disposed within the reservoir and for creating the necessary pressurization. Additional features include a pressurized water supply 112, an inlet/fill conduit 114, and a ball-type check valve 116 in communication with an inlet of the fluid reservoir 108. Upon being pressurized by the expanding bladder 110, the fluid is forced through a discharge closure 118, an outlet conduit 120 and a misting/pour pump subassembly 122.

Figure 11:
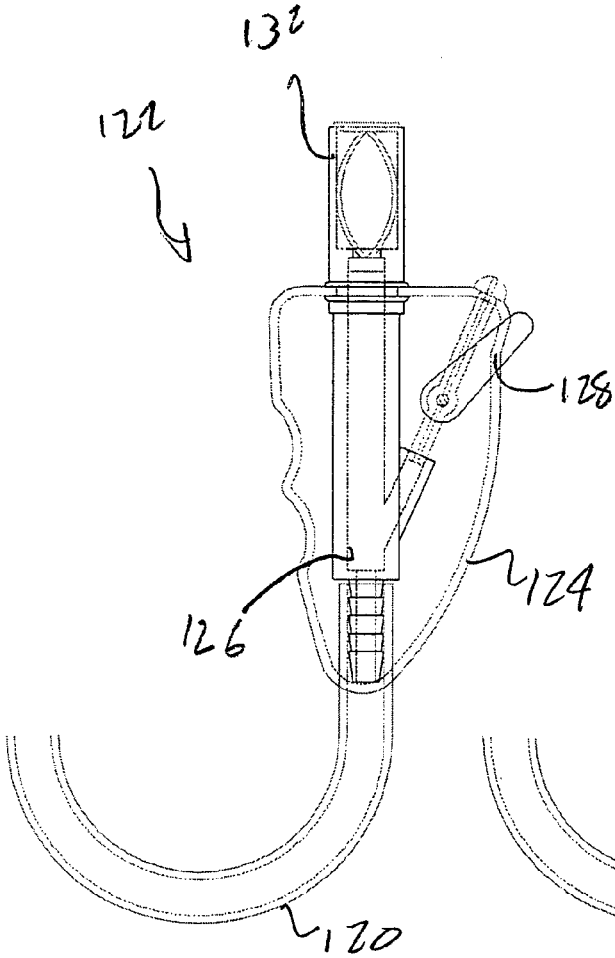
FIG. 11 is a sectional illustration of an alternate configuration of a pump sub-assembly and incorporating a ball valve and actuator arm arrangement for issuing a misting spray.
Figure 11A:
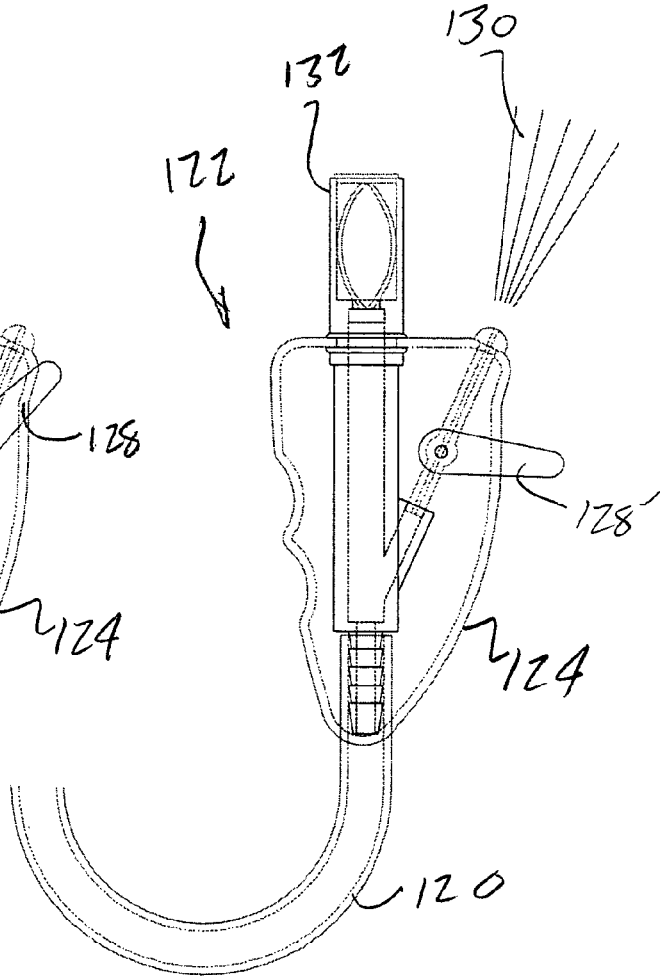
FIG. 11A is a substantially identical illustration of the pump sub-assembly of FIG. 11 and further shown in an actuated and spray misting condition.

The subassembly 122, see also FIGS. 11 and 11A, includes a handpiece enclosure 124, an inlet plenum 126, a ball-type control valve 128 being in communication with a first outlet of the plenum 126 and actuated (see at 128' in FIG. 11A) for issuing a mist spray 130. A drinking nipple and bite valve 132 is in communication with a second outlet of the plenum 126 and is actuated to issue a steady stream fluid. Due again to the internal pressurization caused by the bladder 110, no vacuum/sucking force need be applied to discharge fluid through the nipple and bite valve.

Figure 10:
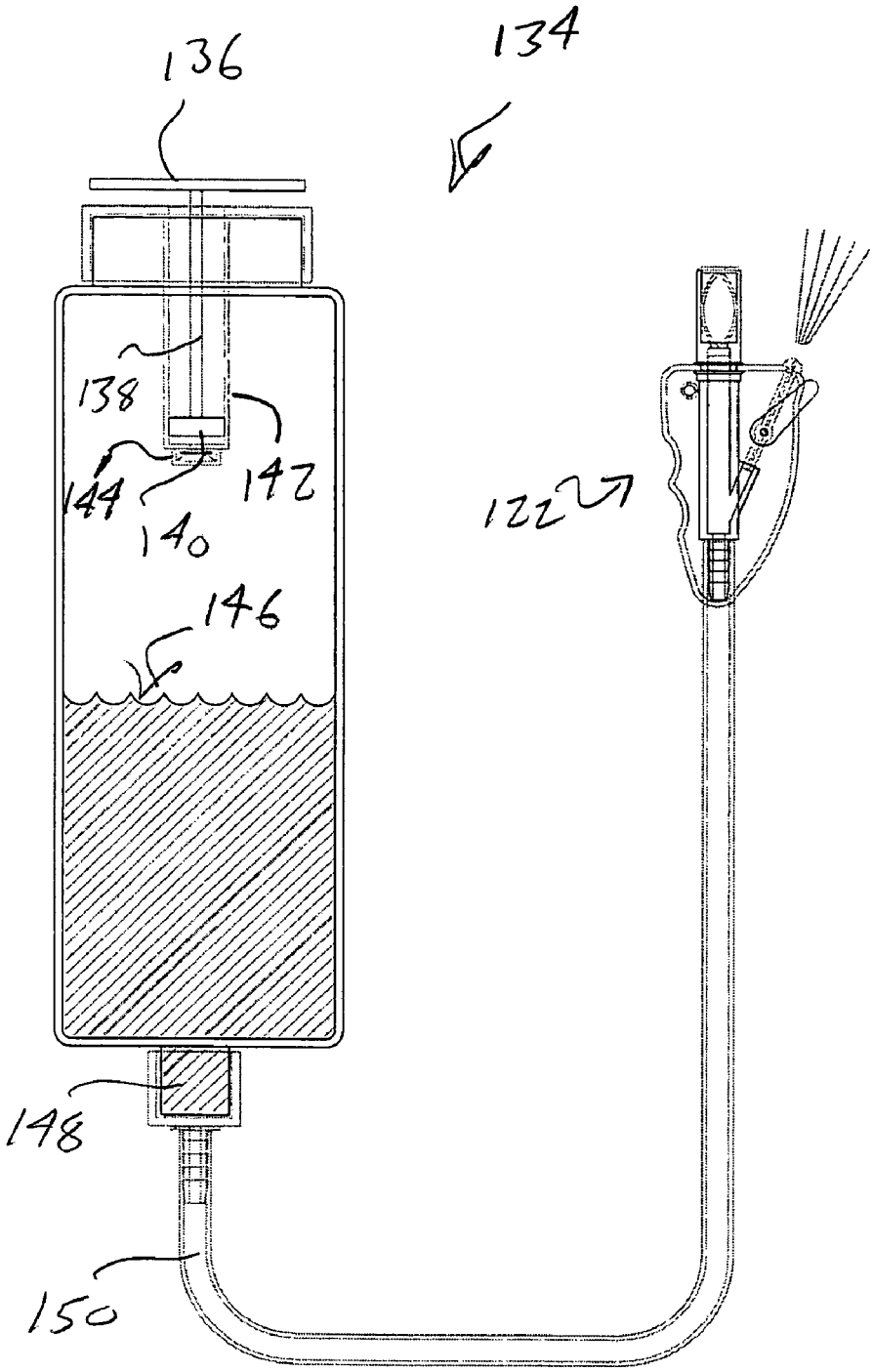
FIG. 10 is an illustration of an alternate pressurization scheme in use with a hydration system and which substitutes the bladder of FIG. 9 with a built-in air pump communicating with the fluid filled reservoir interior.

Referring now to FIG. 10, an illustration is shown at 134 of an alternate pressurization scheme in use with a hydration system, and which substitutes the bladder 110 of FIG. 9 with a built-in air pump assembly communicating with the fluid filled reservoir interior. In particular, the air pump assembly includes a pump actuator handle 136, attached stem 138, pump piston 140, and which is seated within a pump cylinder 142.

Actuation of the piston in the downward direction causes air to be forced under pressure out through apertures in a bottom most location of the cylinder, see at 144, and to pressurize a fluid reservoir interior 146. A discharge fitting 148 of the reservoir body is communicated by an extending conduit 150 and which again terminates in a mist/flow subassembly such as described at 122 in FIG. 9.

Figure 12:
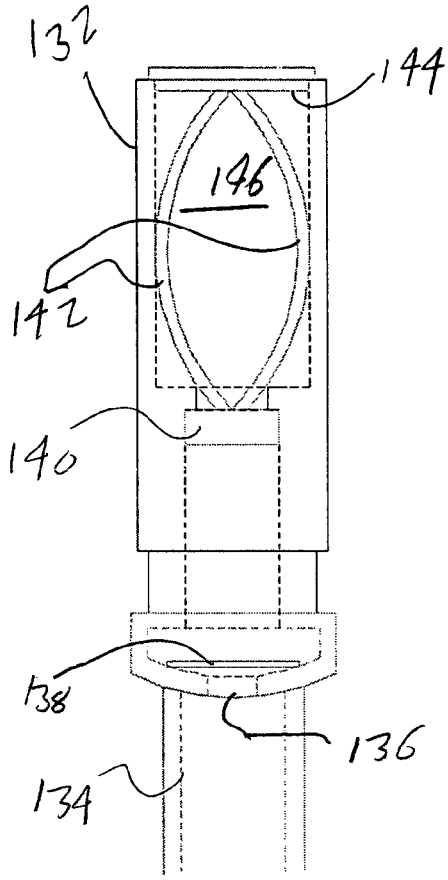
FIG. 12 is an enlarged illustration of the bite valve incorporated into the pump sub-assembly.
Figure 12A:
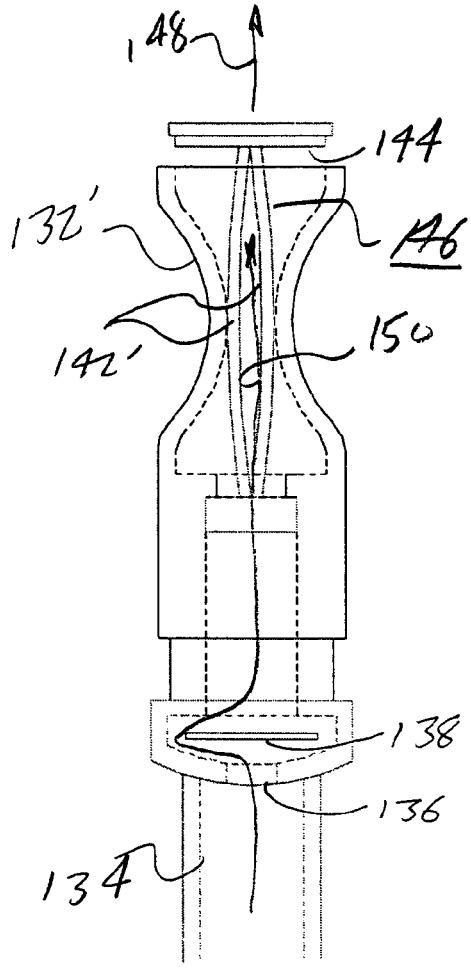
FIG. 12A is a succeeding illustration of the bite valve in an engaged and fluid issuing condition.

Referring to FIGS. 12 and 12A, enlarged illustrations are shown of the bite valve assembly 132 incorporated into the pump sub-assembly. In particular, an inlet plenum 134 leads to a check valve inlet port 136 and check valve flapper 138. Situated within the bite valve assembly is a spring base 140 and a pair of first and second convex shaped and spring bow portions 142. A bite valve seat 144 and associated gate 146 is connected to an upper end of the bow portions 142 and, upon biting/inward deformation of the bow portions 142 as shown in FIG. 12A, the seat and gate are axially displaced, see in direction of arrow 148, to allow a path for a steady stream fluid discharge 150.

Figure 13B:
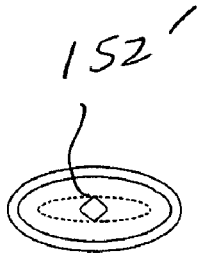
FIG. 13B is a succeeding end view illustration of the bite valve and illustrating the flexure of the valve body, resulting from inward biting by the user's teeth, and resulting in the opening of the slit, allowing the user to suck water through the opening.
Figure 13A:
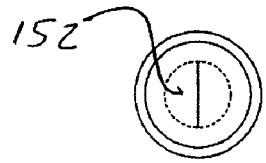
FIG. 13A is an end view illustration of the bite valve of FIG. 13 in a closed position.
Figure 13:
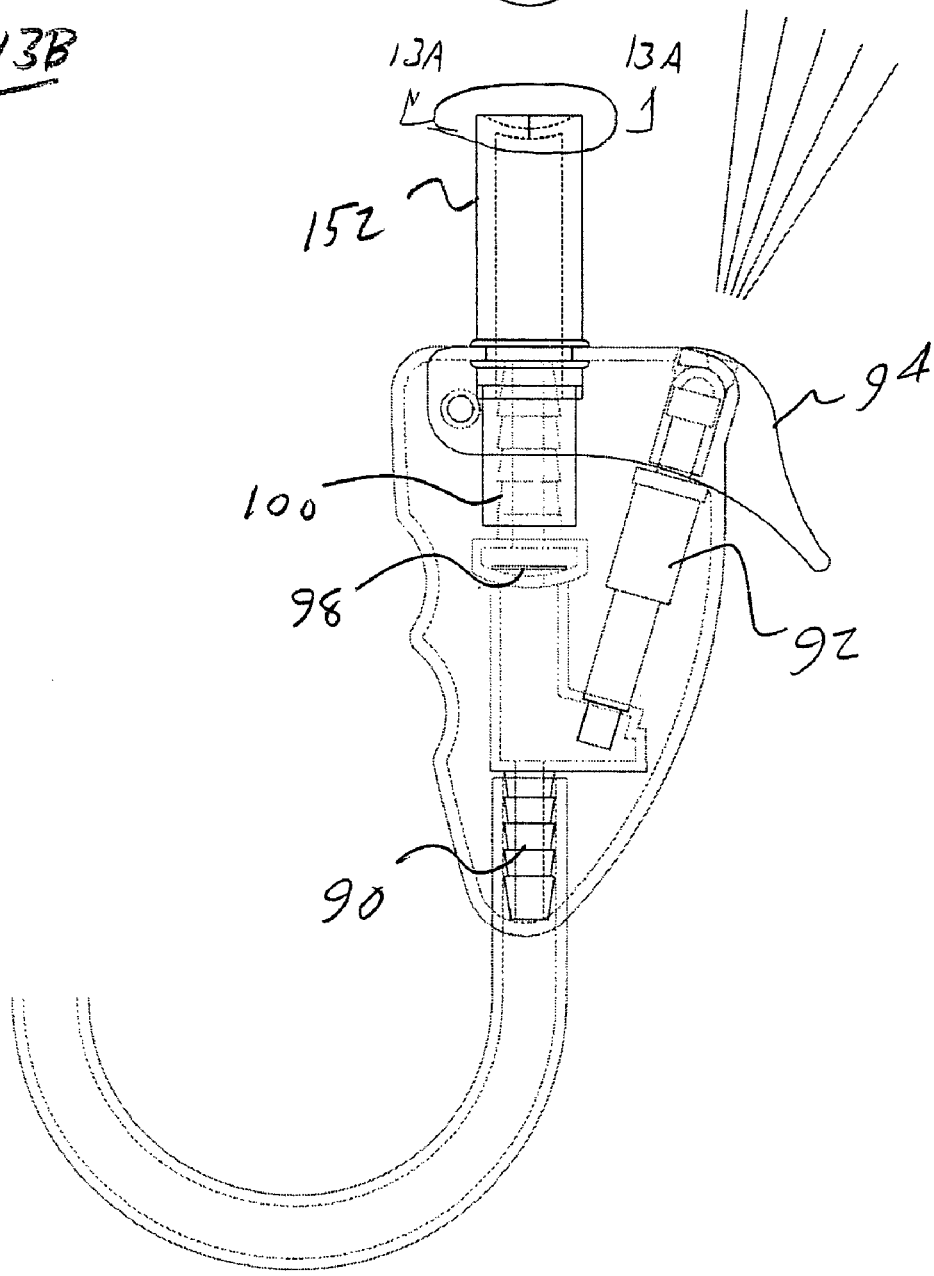
FIG. 13 is an illustration of a modified bite valve from that shown in FIGS. 12 and 12A, applied to a misting/fluid sub-assembly according to the present invention.

Referring to FIGS. 13, 13A and 13B, first and second illustrations of a further variant of bite valve, applied to a misting/fluid sub-assembly according to the present invention. In particular, FIG. 13A is an end view illustration of the bite valve of FIG. 13 in a closed position and by which an end slit 152 is illustrated in a closed position. In contrast, FIG. 13B illustrates a succeeding end view of the bite valve and illustrating the flexure of the valve body to an open position 152', resulting from inward biting by the user's teeth, and resulting in the opening of the slit, allowing the user to suck water through the opening. In comparison, the bite valve of FIGS. 12 and 12A is in the form of a moving disk valve gate.

FIGS. 14 and 14A are closed and open sectional illustrations, respectively, of a suction operated valve incorporated into a drinking nipple and in a normally closed position. In particular, FIG. 14 illustrates a valve 154 extending from an end of a plenum outlet 156, and by which a valve insert 156 and valve seat 158 is biased in a normally closed position through the influencing force of a coil spring 160. Referring further to FIG. 14A, a suction force is applied to a disk 162 the valve seat 158, overcoming the force of the spring 160, and in order to unseat the same in an axially extending direction from the valve seat 158 and to permit fluid flow as evidenced by arrows 157. Upon release of the suction force, the spring forces re-exert the disk 162 and seat 158 in a closing direction.

Figure 15:
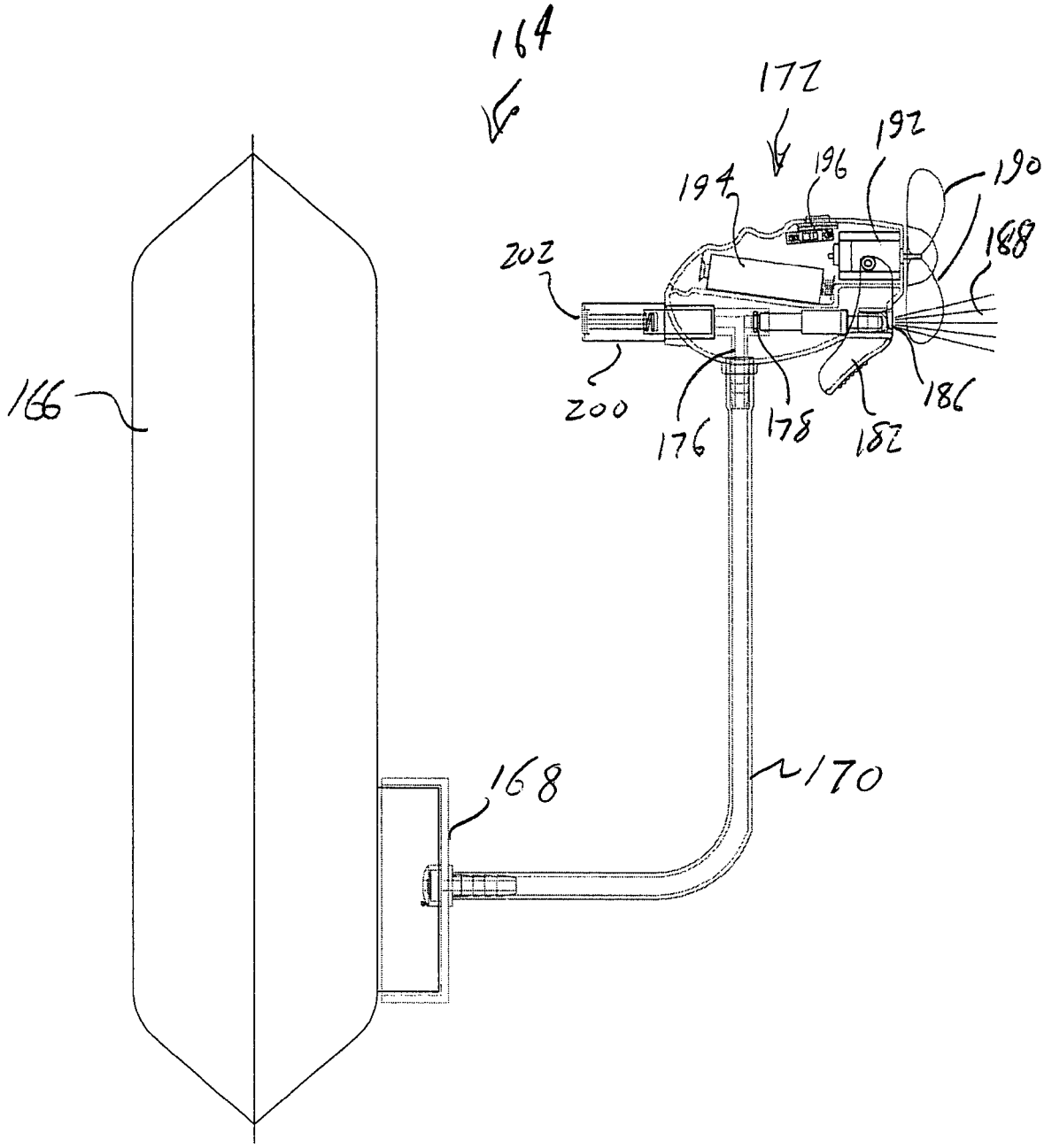
FIG. 15 is an illustration of a personal hydration system exhibiting a flexible and fluid-filled bladder reservoir and with drinking, misting and fan cooling functions incorporated within a conduit attached handpiece.

Referring now to FIG. 15, an illustration 164 is generally shown of a personal hydration system exhibiting a flexible and fluid-filled bladder reservoir 166. A reservoir port and closure 168 interconnects the bladder reservoir 166 with an extending conduit 170, the same terminating in a handpiece 172 combining the features of drinking, misting and fan cooling functions.

Figure 16:
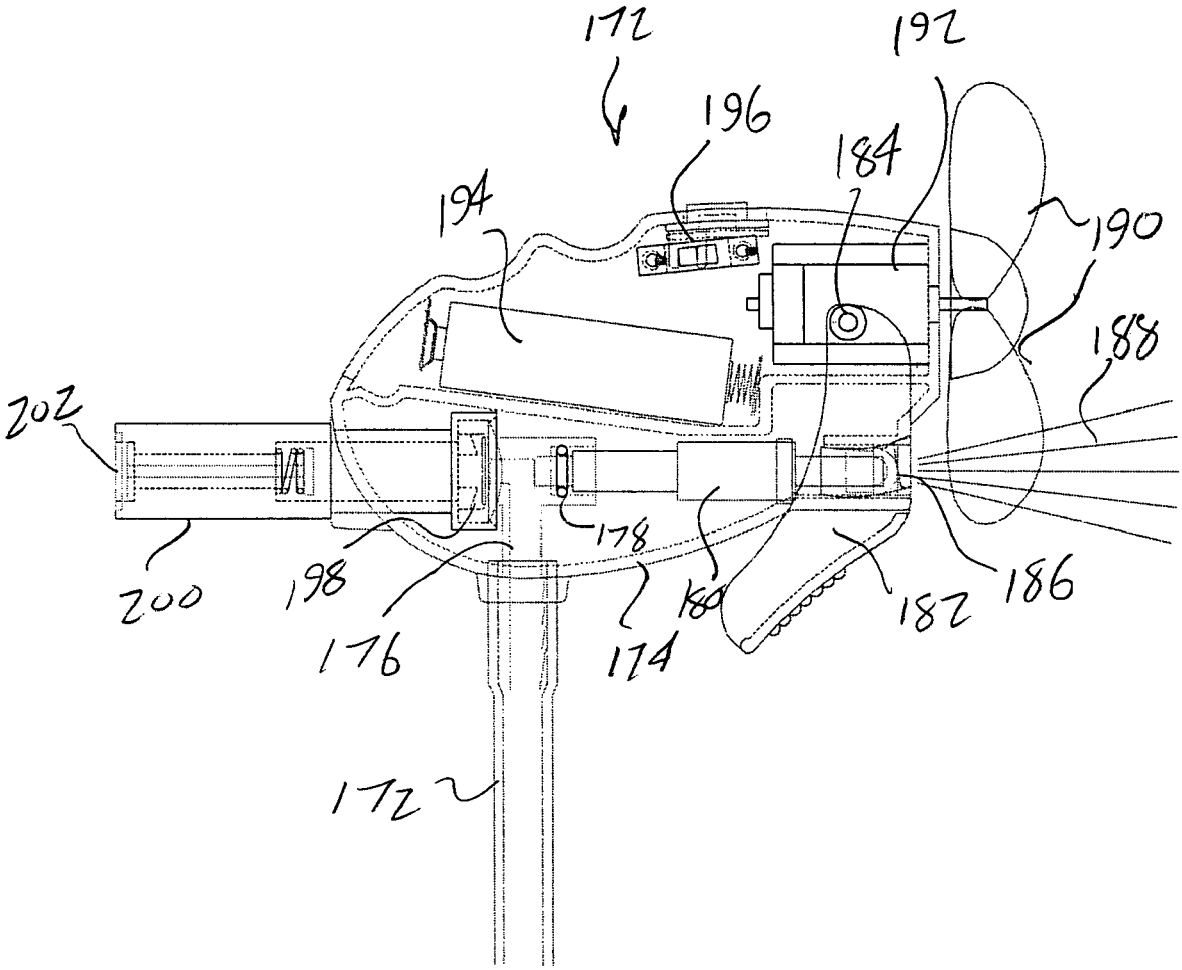
FIG. 16 is an enlarged illustration of the multi-function spray/fluid/fan cooling handpiece illustrated in FIG. 15.

In particular, and referring also to the enlarged view of FIG. 16, the handpiece 172 includes a three-dimensional handpiece body 174 within which extends an inlet plenum 176 fluidly communicating with the opposite end of the conduit 170. An O-ring 178 separates a first outlet of the plenum 176 with a piston pump 180, the same further being actuated by a pump actuator arm 182 hingedly connected to the body 174 at pivot point 184.

An orifice 186 is located in alignment with an outlet of the piston pump and, upon being actuated by arm 182, causes a mist spray 188 to be issued through a plurality of rotating blades 190 associated with a fan. A motor 192 is powered by a battery 194 and in turn activated by a switch 196 in order to selectively activate and deactivate the impeller blade and hub associated with the fan unit. A check valve 198 is located in fluidic communication with a second outlet associated with the inlet plenum 176 and in turn is communicated with a drinking nipple 200 and suction operated valve 202 (substantially as previously described), and in order to provide a steady stream fluid flow.

Figure 17A:
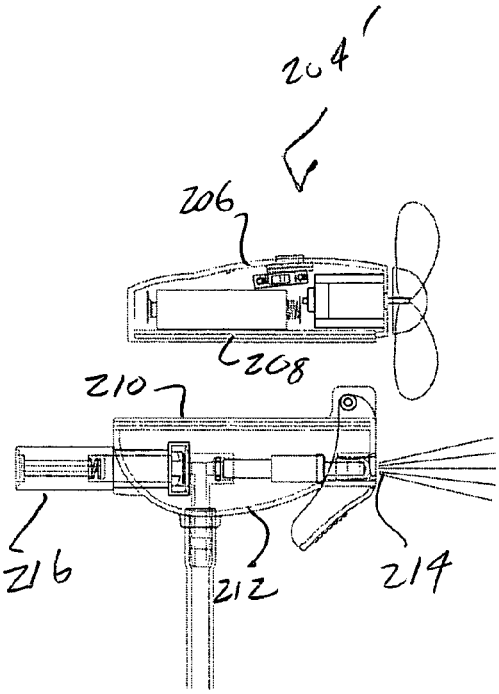
FIG. 17A is a further illustration of the handpiece of FIG. 17 in an exploded illustration.
Figure 17:
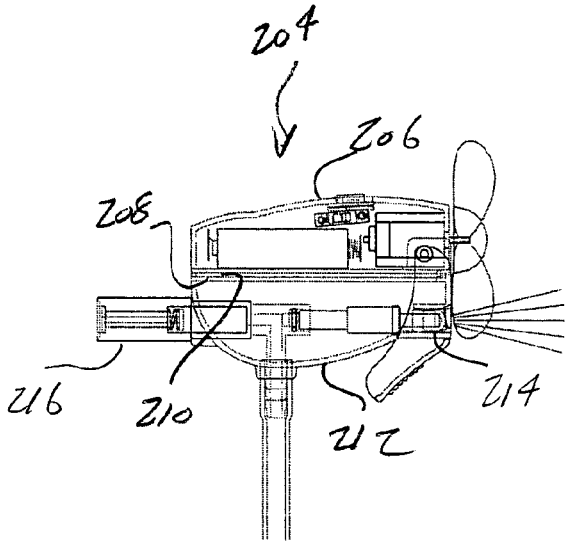
FIG. 17 is an alternate variant of a multi-functional handpiece and illustrating the feature of a removable fan enclosure subassembly.

FIG. 17 is an alternate variant 204 of a modification of the multi-functional handpiece illustrated and described in FIGS. 15 and 16 and illustrating the feature of a removable fan enclosure subassembly 206. In particular, the fan unit includes an upper attachable fan enclosure subassembly as shown, and from which extend interengaging attachment rails 208 and 210 along each of the fan subassembly 204 and a conduit attached main subassembly 212 incorporating both spray mister 214 and bite valve and nipple (steady stream flow) 216 components.

Figure 18:
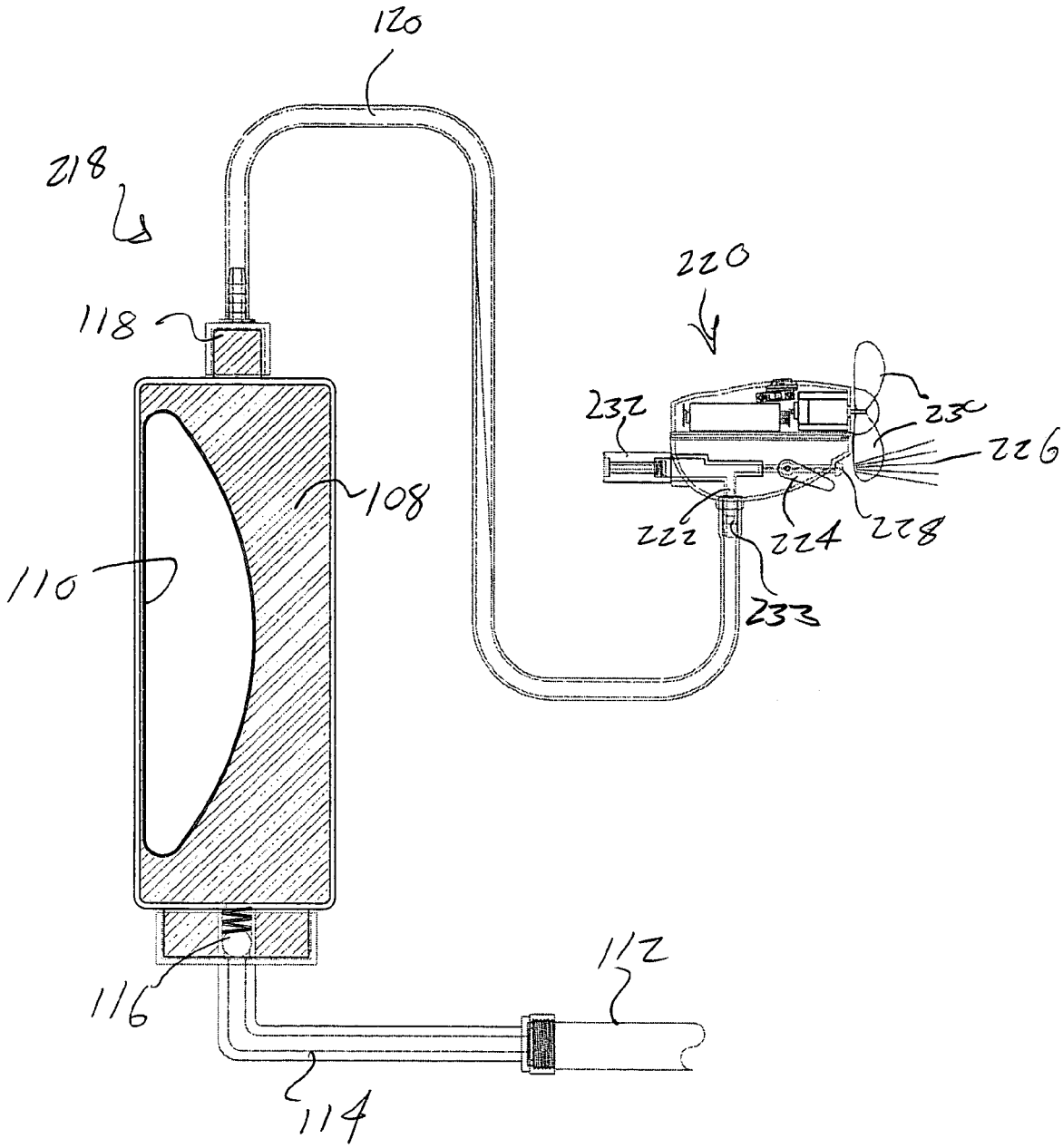
FIG. 18 is an illustration of a personal hydration system with internally pressurized and air-filled bladder along with the multi-function handpiece of FIG. 17.

Referring now to FIG. 18, an illustration is shown at 218 of a personal hydration system and which combines the previously described components of the internally pressurized and air filled bladder (see again as repetitively described by elements 108–118 in FIG. 9) along with a further variant 220 of a multi-function handpiece.

Inlet plenum 222 of the handpiece subassembly communicates fluid flow across a first outlet with a lever actuated ball valve 224, which in turn actuates a mist spray 226 across an orifice 228 in communication with a fan impeller hub and motor set 230. A drinking nipple 232 is again fluidly communicated with a second plenum outlet and, upon being actuated, generates a steady stream fluid flow from the internally pressurized reservoir 108. Check valves in this variant are removed and the pump replaced with a proportional control valve 233 at the inlet to the dip tube.

Figure 19:
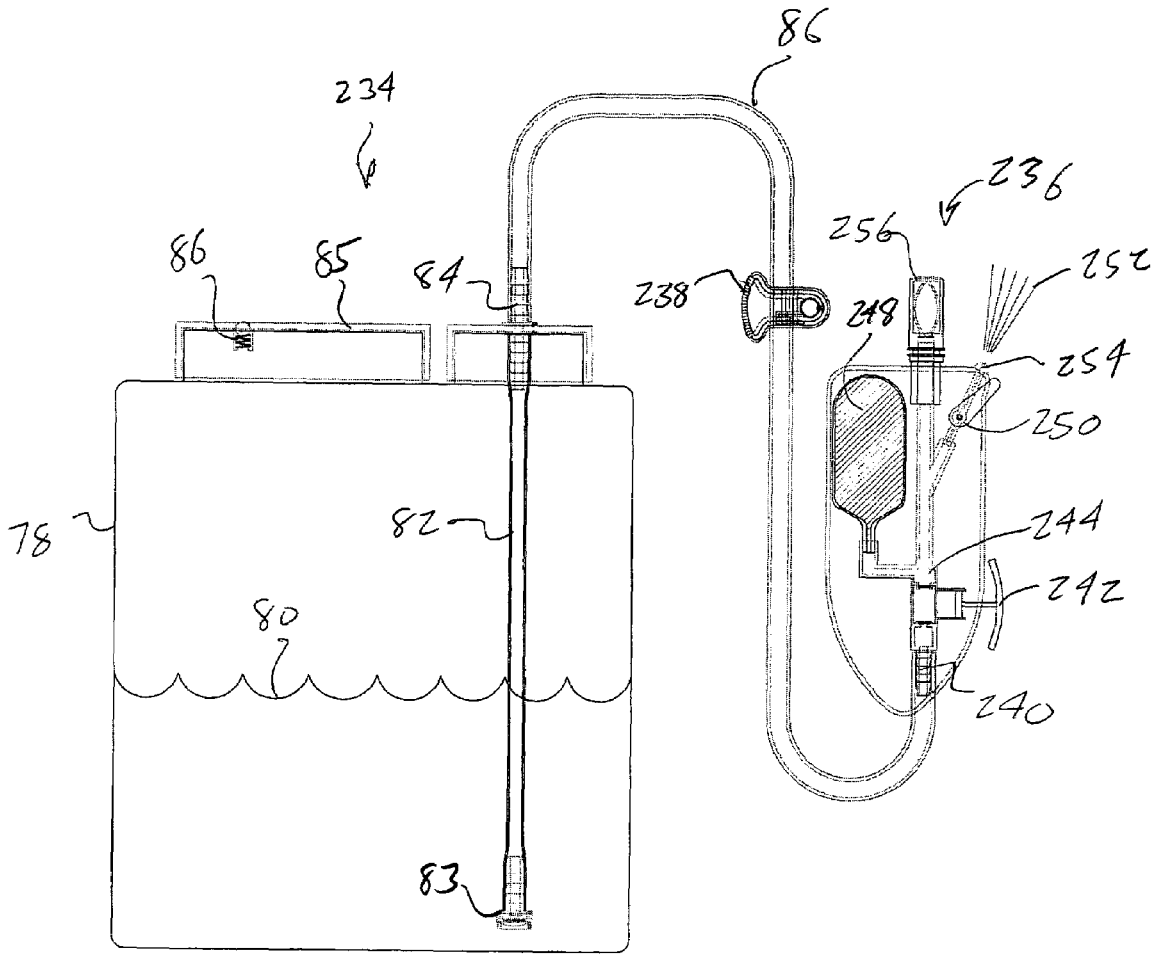
FIG. 19 is an illustration of a personal hydration system according to a further preferred embodiment of the present invention and illustrating a fluid filled reservoir of the embodiment shown in FIG. 7 combined with a further variant of the misting and sipping handpiece according to the present invention.

FIG. 19 is an illustration 234 of a personal hydration system according to a further preferred embodiment of the present invention and illustrating an unpressurized and fluid filled reservoir 78 of the embodiment shown in FIG. 7, combined with a further variant of the misting and sipping handpiece 238 according to the present invention. A clip 238, attached to an intermediate location of the conduit 86, and in order to secure the same such as to the user's shirt or the like.

Figure 20:
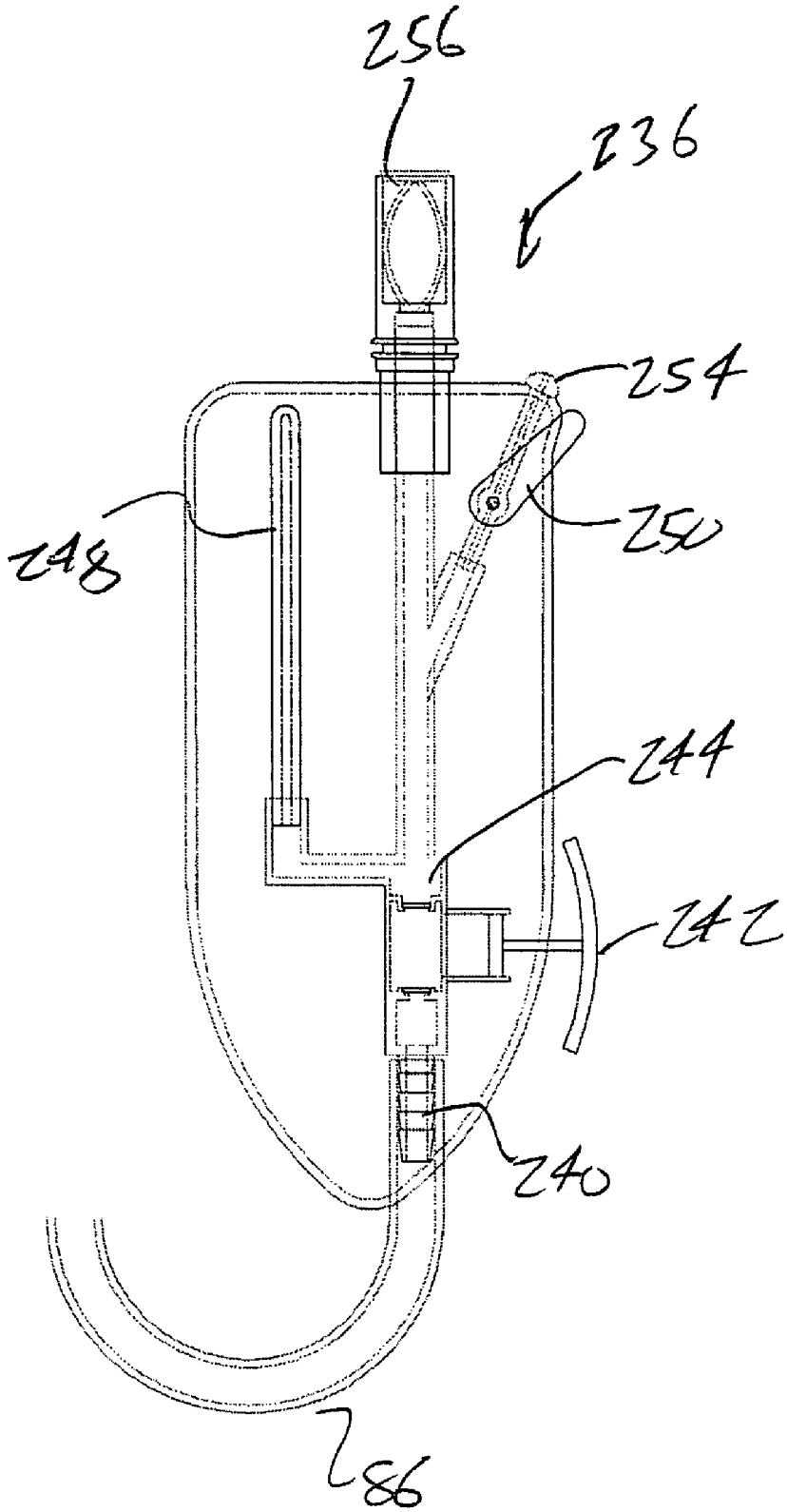
FIG. 20 is an enlarged view of the multi-function handpiece shown in FIG. 19.

The handpiece enclosure 236, as also illustrated in enlarged fashion in FIG. 20, secures to an extending end of the conduit 86 and incorporates an inlet 240, a pump handle 242 securing in fluidic communication to a plenum 244 extending from the inlet 240. An elastic and pressurized bladder 248 (illustrated in a collapsed position in FIG. 20) is provided in fluidic communication with the pump handle and a handle actuated ball valve 250 fluidly communicates with a first outlet of the plenum 244 and, upon being engaged, issues a mist spray 252 through an outlet orifice 254. A combination bite valve and nipple 256 fluidly communicates with a second outlet of the plenum and, upon being engaged, issues a steady-stream fluid flow.

Figure 8:
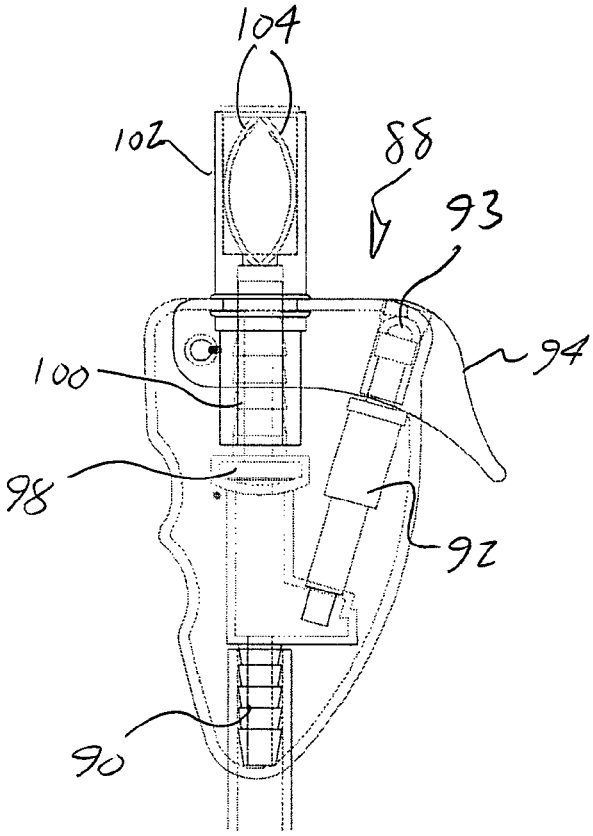
FIG. 8 is an enlarged view of the pump sub-assembly shown in FIG. 7.
Figure 21:
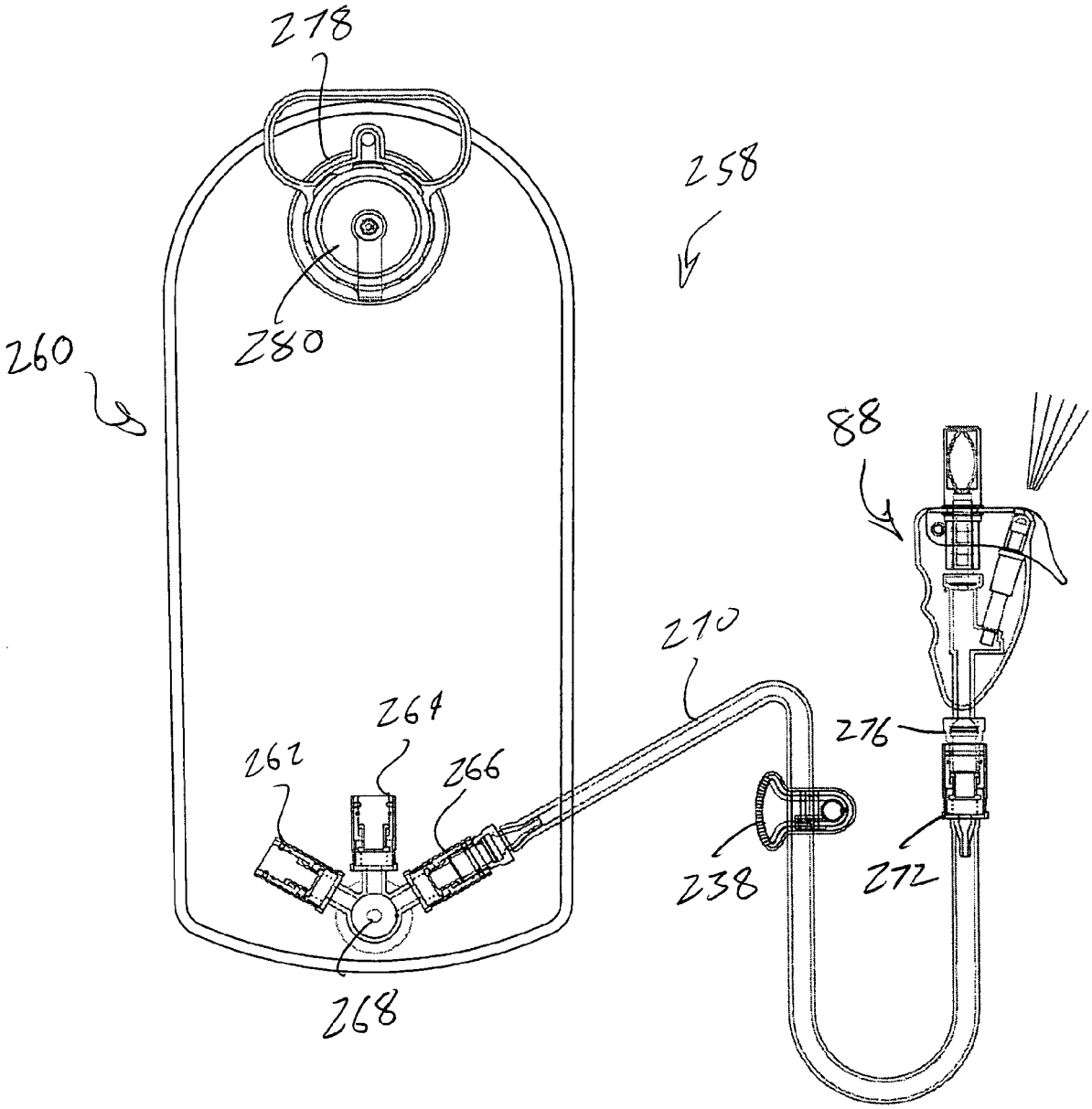
FIG. 21 is an illustration of a personal hydration system including an unpressurized reservoir and a pump sub-assembly as previously illustrated in FIG. 8, the components being designed for east of separability for customization and repair.

FIG. 21 is an illustration of a personal hydration system 258, including an unpressurized reservoir body 260 and a pump sub-assembly as previously illustrated in FIG. 8. A plurality of axially biasing and connect fittings 262, 264 and 266 extend from a discharge port 268 associated with the reservoir, at least one conduit, see at 270, securing to a selected fitting 266.

Figure 8A:
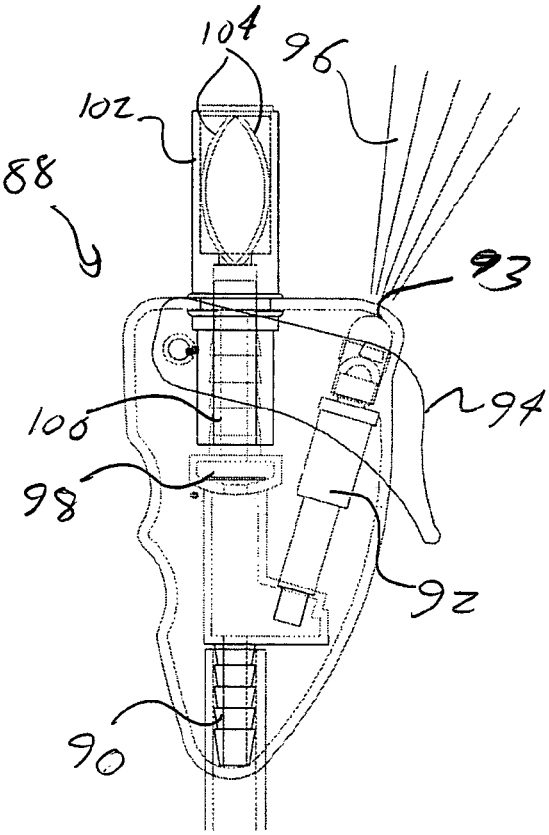
FIG. 8A is a further illustration of the pump sub-assembly in an actuated and spray misting condition.
Figure 22:
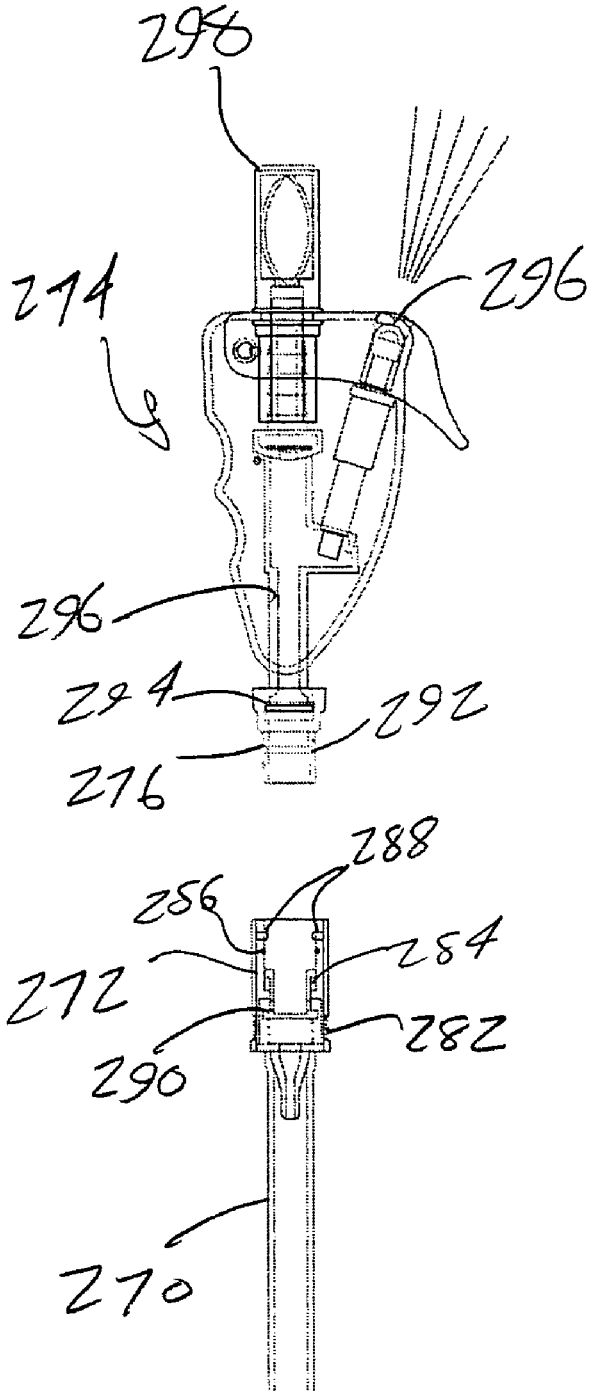
FIG. 22 is an exploded illustration of a misting and fluid sub-assembly, attached in quick-connect fashion to an extending end of a reservoir connected conduit and according to the present invention.

Referring also to FIG. 22, a quick-connect fitting 272 extends from a remote end of the conduit 270, a mist/pour sub-assembly 274 incorporating an interengaging quick connect fitting 276 securing to the conduit end and incorporating orifices for issuing both the mist spray and steady stream fluid flow, reference again being made to the disclosure of FIGS. 8 and 8A. A combination hanging loop and carry handle 278 secures to an upper end of the reservoir body 260, a cap 280 engaging the handle and being removed to define a reservoir fill port.

Referring again to FIG. 22, the quick-connect fitting 272 includes a sleeve spring 282, sliding sleeve 284, O-ring 286 and holding pins 288. A gate for a spool type valve 290 seats an inserting end of the quick connect fitting 276, the same also including a groove 292 for seating by the holding pins 288. A flapper type check valve 294 feeds fluid to an inlet plenum 296 of the handpiece and for subsequent spray misting 296 or steady stream fluid flow 298 in the manner previously described.

Figure 23:
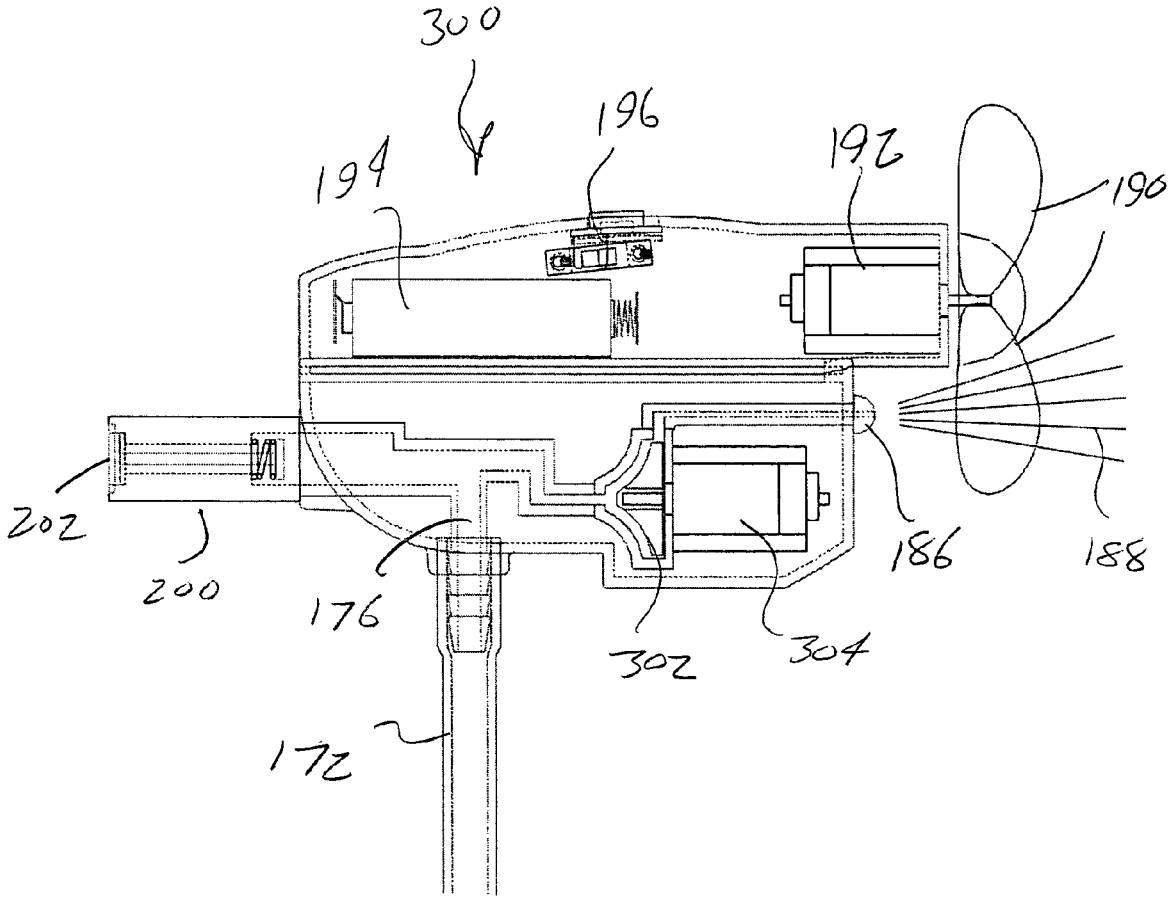
FIG. 23 is a further sectional illustration of a multi-functional handpiece and which incorporates a rotary pump for generating a pressurized misting spray downstream from an unpressurized fluid reservoir.

FIG. 23 is a further sectional illustration of a multi-functional handpiece 300, similar in numerous respects to that previously described in reference to FIG. 16, and which incorporates a rotary pump 302, driven by pump motor 304, and for generating a pressurized misting spray downstream from an unpressurized fluid reservoir (not shown). Common elements from the variant of FIG. 16 are represented in the variant of FIG. 23.

Figure 24:
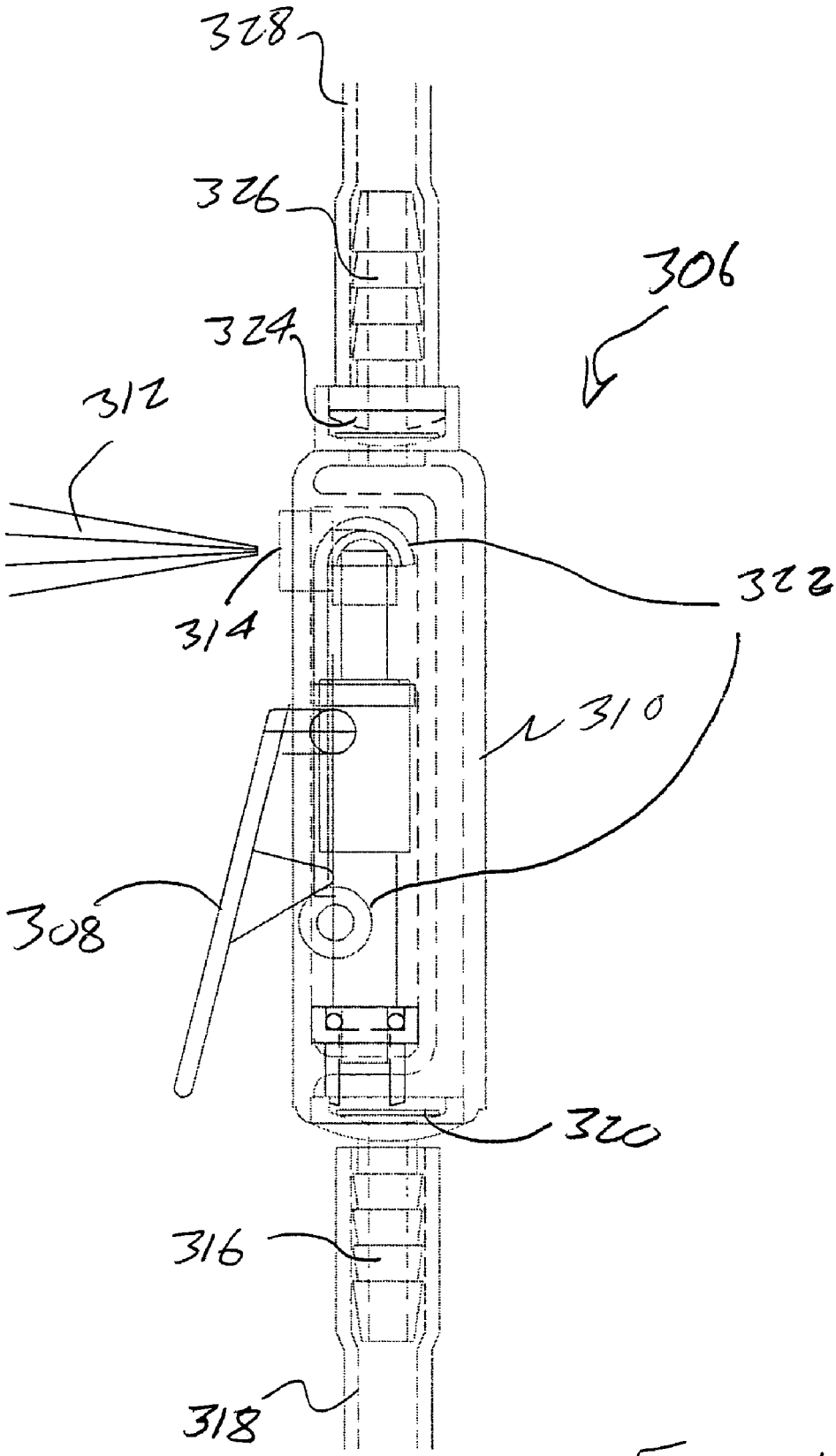
FIG. 24 is an illustration of an in-line misting and fluid attachment device in use with a fluid filled reservoir according to a further preferred embodiment of the present invention.

FIG. 24 is an illustration 306 of an in-line misting and fluid attachment device in use with a fluid filled reservoir (again not shown) according to a further preferred embodiment of the present invention. A pump actuator arm 308 secures to a body 310 of the subassembly and, upon being actuated, causing a fixed volume of a mist spray 312 to issue from an associated orifice 314.

The in-line subassembly further includes a hose attachment fitting 316 connects to a remote conduit end 318. An inlet check valve 320 is in fluid communication with the attachment fitting 316 and a sliding actuator bracket 322 is engaged upon actuation of the pump actuator arm 308. A discharge check valve 324 is arranged at an outlet end 326 of the fitting and a further hose attachment 328 fitting extending from an outlet end.

Figure 25:
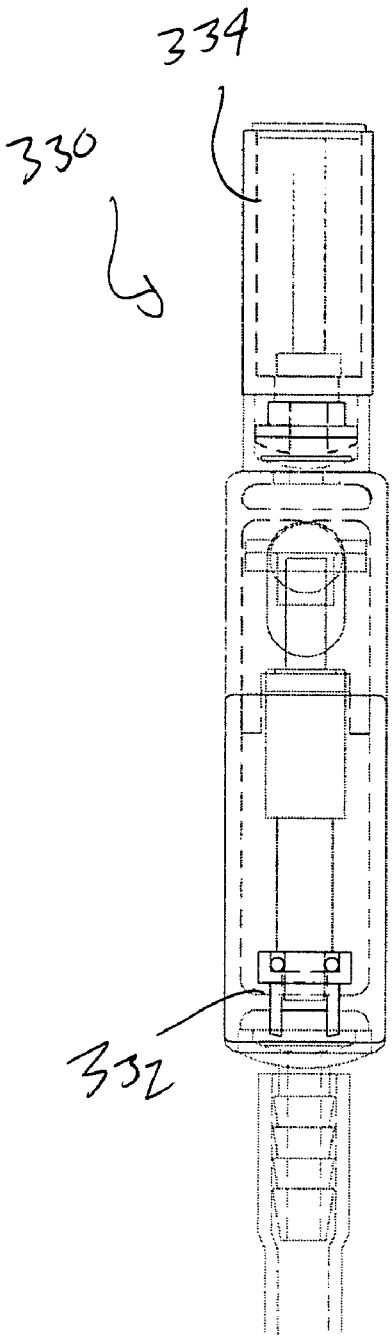
FIG. 25 is a succeeding illustration of a further variant of an in-line misting device and which substitutes a check valve for the barbed fitting at the discharge end of the enclosure, the outlet of the check valve flowing into a drinking nipple.
Figure 25A:
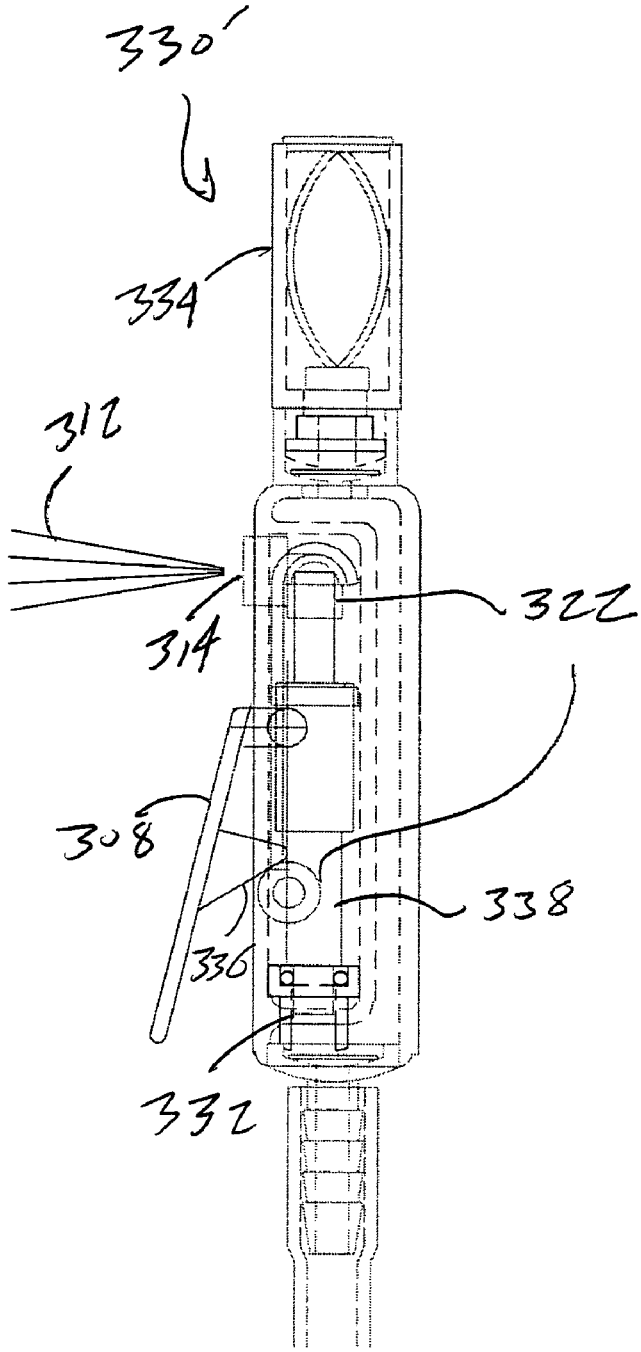
FIG. 25A is a ninety degree rotated view of the in-line misting device shown in FIG. 25 and illustrating the spray misting device actuated to the open position.

FIGS. 25 and 25A are succeeding and 90 degree rotated illustrations 330 and 330' of both a terminus attached end and an in-line attached misting device and which substitutes a check valve 332 for the barbed fitting at the discharge end of the enclosure. The outlet of the check valve 332 flows into a bite valve actuated drinking nipple 334, as previously described. Referring again to FIG. 25A, a ninety degree rotated view of the in-line misting device shown in FIG. 25 illustrates the spray misting device actuated to the open position. First and second cam surfaces 336 and 338 (see again FIG. 25A) are arranged between the pump actuator arm 308 and sliding actuator bracket 322 to facilitate actuation of the spray mister.

Figure 26:
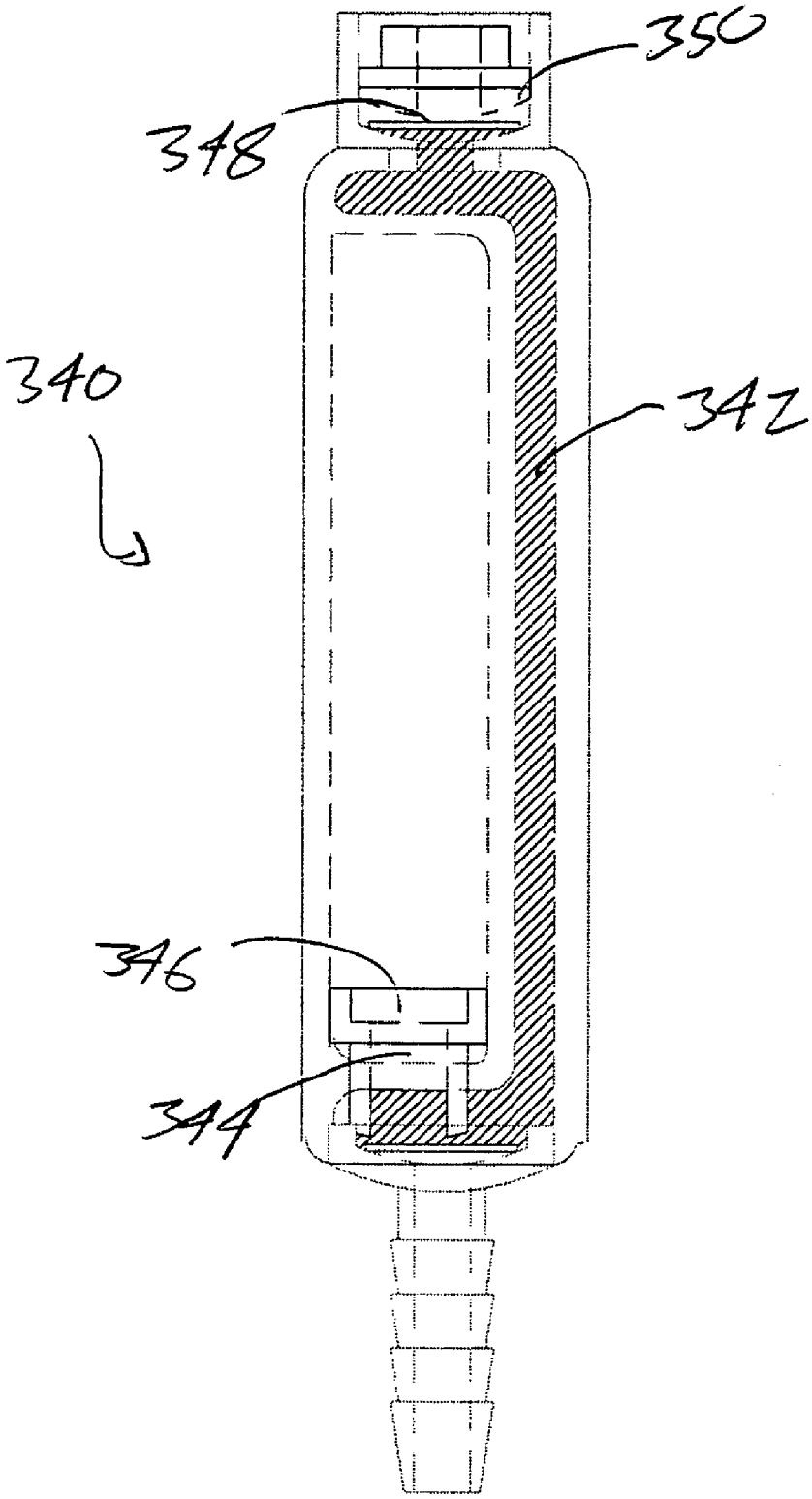
FIG. 26 is an illustration of a water-filled plenum device and with the pump and orifice being removed for purpose of clarity.

Referring finally to FIG. 26, an illustration is shown of a water-filled plenum device 340 and with the pump and orifice being removed for purpose of clarity. The cross-hatched area 342 illustrated represents fillable water. Upstream of a plenum 344 is a first check valve flapper 346 and a narrowed portion of the pump (sealed with an O-ring as previously described in FIGS. 24 and 25) is a flapper 348 associated with a second check valve 350.

Having described our invention, other and additional preferred embodiments will become apparent to those skilled in the art to which it pertains and without deviating from the scope of the appended claims.

We claim:

1. A portable misting device, comprising:

a body having an internal and fluid holding reservoir;

a fill port for refilling said fluid holding reservoir;

at least one discharge port spaced apart from said fill port and in fluidic communication with said reservoir;

a fluid conveying conduit extending from said discharge port and terminating in an orifice, said orifice being actuated to issue a mist spray, said orifice further comprising a hand-held pump subassembly for issuing fluid in at least one of said mist spray and a steady fluid flow;

said pump subassembly further comprising:

an inlet plenum;

a piston pump secured to a first outlet associated with said plenum, said orifice defining an outlet location of said piston pump; and a pump actuator mechanism secured to said sub-assembly and, upon being depressed, engaging said piston pump to issue said mist spray;

said pump subassembly further comprising a bite valve and which incorporates a slit deformable in a radially outward direction and upon being depressed radially inwardly; and an inlet check valve associated with said reservoir and preventing the introduction of air into said discharge port and fluid conveying conduit.

2. The portable misting device as described in claim 1, further comprising a squeeze bulb pump arranged in fluidic communication with said discharge port.

3. The portable misting device as described in claim 1, further comprising a misting fan incorporating said orifice and secured to an extending end of said conduit, a squeeze bulb incorporated into said a body associated with said misting fan and, upon being compressed, issuing said mist spray into a path of a plurality of rotating blades associated with said fan.

4. The portable misting device as described in claim 1, further comprising a dual check valve secured to a location of said conduit and in fluidic communication with said reservoir, said check valve communicating said reservoir with at least one of said spray orifice and a drinking spout and to permit one-way flow of fluid from said reservoir.

5. The portable misting device as described in claim 4, further comprising said check valve being located on an inlet side corresponding to at least one piston pump.

6. The portable misting device as described in claim 1, further comprising said inlet check valve being supported upon an end a dip tube extending within said fluid reservoir and in communication with said discharge port.

7. The portable misting device as described in claim 1, said fluid conveying conduit further comprising a flexible conduit.

8. The portable misting device as described in claim 1, further comprising an internally pressurized bladder arranged within said fluid holding reservoir.

9. The portable misting device as described in claim 8, said discharge port further comprising a discharge closure and to which an inlet end of said conduit is engaged.

10. The portable misting device as described in claim 1, further comprising a fan unit secured to an extending end of said conduit said orifice further comprising at least one of a pump actuated spray mister and a steady-stream permitting orifice.

11. The portable misting device as described in claim 1, further comprising a handpiece enclosure secured to an extending end of said conduit and incorporating said orifice in order to issue at least one of a mist spray and a steady-stream fluid flow.

12. The portable misting device as described in claim 1, further comprising a plurality of connect fillings extending from said discharge port, at least one of said conduits securing to a selected fitting.

13. The portable misting device as described in claim 12, a quick-connect fitting extending from a remote end of said conduit, a sub-assembly incorporating an interengaging quick connect filling securing to said conduit end and incorporating said orifice for issuing at least one of said mist spray and a steady stream fluid flow.

14. A portable misting device, comprising:

a body having an internal and fluid holding reservoir;

a fill port for refilling said fluid holding reservoir;

at least one discharge port separate from said fill port and in fluidic communication with said reservoir;

a fluid conveying conduit extending from said discharge port and terminating in an orifice, said orifice being actuated to issue a mist spray;

said orifice further comprising a hand-held pump subassembly for issuing fluid in at least one of said mist spray and a steady fluid flow, said pump subassembly further comprising at least one of a flapper-type cheek valve in operative communication with a second outlet associated with said plenum, and a drinking nipple incorporating a bite valve insert, deformation of said insert permitting a steady stream fluid flow through said nipple.

15. The portable misting device as described in claim 14, said bite valve insert associated with said drinking nipple further comprising first and second convex shaped and spring bow portions, a bite valve seat and bite valve gate axially displacing from said nipple in response to deformation thereto and in order to permit said steady stream fluid flow.

16. A portable misting device, comprising:

a body having an internal and fluid holding reservoir;

a fill port for refilling said fluid holding reservoir;

at least one discharge port separate from said fill port and in fluidic communication with said reservoir;

a fluid conveying conduit extending from said discharge port and terminating in an orifice, said orifice being actuated to issue a mist spray; and said orifice further comprising a hand-held pump subassembly for issuing fluid in at least one of said mist spray and a steady fluid flow, said pump subassembly further comprising:

an inlet plenum;

a control valve secured to a first outlet associated with said plenum; and a valve actuator arm pivotally mounted to said control valve by an interiorly disposed ball valve such that, upon being engaged, said control valve issues said mist spray.

17. A portable misting device, comprising:

a body having an internal and fluid holding reservoir;

a fill port for refilling said fluid holding reservoir;

at least one discharge port separate from said fill port and in fluidic communication with said reservoir;

a fluid conveying conduit extending from said discharge port and terminating in an orifice, said orifice being actuated to issue a mist spray;

said orifice further comprising a hand-held pump subassembly for issuing fluid in at least one of said mist spray and a steady fluid flow, said pump subassembly further comprising:

an inlet plenum;

a piston pump secured to a first outlet associated with said plenum, said orifice defining an outlet location of said piston pump;

a pump actuator mechanism secured to said sub-assembly and, upon being depressed, engaging said piston pump to issue said mist spray; and a bite valve incorporating a slit deformable in a radially outward direction and upon being depressed radially inwardly.

18. A portable misting device, comprising:

a body having an internal and fluid holding reservoir;

a fill port for refilling said fluid holding reservoir;

at least one discharge port separate from said fill port and in fluidic communication with said reservoir;

a fluid conveying conduit extending from said discharge port and terminating in an orifice, said orifice being actuated to issue a mist spray;

said orifice further comprising a hand-held pump subassembly for issuing fluid in at least one of said mist spray and a steady fluid flow, said pump subassembly further comprising:

an inlet plenum;

a piston pump secured to a first outlet associated with said plenum, said orifice defining an outlet location of said piston pump;

a pump actuator mechanism secured to said sub-assembly and, upon being depressed, engaging said piston pump to issue said mist spray; and a suction-actuated valve having an outer and cylindrical shaped body, a spring loaded and axially displaceable valve insert actuating to permit said steady stream fluid flow.

19. A portable misting device, comprising:

a body having an internal and fluid holding reservoir;

a fill port for refilling said fluid holding reservoir;

at least one discharge port separate from said fill port and in fluidic communication with said reservoir;

a fluid conveying conduit extending from said discharge port and terminating in an orifice, said orifice being actuated to issue a mist spray;

a handpiece enclosure secured to an extending end of said conduit and incorporating said orifice in order to issue at least one of a mist spray and a steady-stream fluid flow, said handpiece enclosure further comprising:

an inlet;

a pump handle secured in fluidic communication to a plenum extending from said inlet;

an elastic and pressurized bladder in fluidic communication with said plenum;

a handle actuated valve fluidly communicating with a first outlet of said plenum and, upon being engaged, issuing said mist spray; and a combination bite and nipple valve fluidly communicating with a second outlet of said plenum and, upon being engaged, permitting said steady-stream fluid flow.

20. A portable misting device, comprising:

a body having an internal and fluid holding reservoir;

a fill port for refilling said fluid holding reservoir;

at least one discharge port spaced apart from said fill port and in fluidic communication with said reservoir;

a fluid conveying conduit extending from said discharge port and terminating in an orifice, said orifice being actuated to issue a mist spray, said orifice further comprising a hand-held pump subassembly for issuing fluid in at least one of said mist spray and a steady fluid flow;

said pump subassembly further comprising:

an inlet plenum;

a piston pump secured to a first outlet associated with said plenum, said orifice defining an outlet location of said piston pump; and a pump actuator mechanism secured to said sub-assembly and, upon being depressed, engaging said piston pump to issue said mist spray;

said pump subassembly further comprising a suction-actuated valve having an outer and cylindrical shaped valve body, a spring loaded and axially displaceable valve insert actuating to permit said steady stream fluid flow; and an inlet check valve associated with said reservoir and preventing the introduction of air into said discharge port and fluid conveying conduit.

* * * * *

UNITED STATES PATENT AND TRADEMARK OFFICE

CERTIFICATE OF CORRECTION

PATENT NO. : 7,243,860 B2
APPLICATION NO. : 10/974098
DATED : July 17, 2007
INVENTOR(S) : Eric Junkel It is certified that error appears in the above-identified patent and that said Letters Patent is hereby corrected as shown below:

Column 10, line 44, replace “fillings” with --fittings--

Column 10, line 50, replace “filling” with --fitting--

Signed and Sealed this

Sixth Day of November, 2007

JON W. DUDAS
*Director of the United States Patent and Trademark Office*